US009442416B2

(12) United States Patent
Magome et al.

(10) Patent No.: US 9,442,416 B2
(45) Date of Patent: Sep. 13, 2016

(54) IMAGE-FORMING APPARATUS, IMAGE-FORMING METHOD, DEVELOPING APPARATUS, AND DEVELOPING METHOD

(71) Applicant: CANON KABUSHIKI KAISHA, Tokyo (JP)

(72) Inventors: Michihisa Magome, Mishima (JP); Takashi Matsui, Mishima (JP); Kozue Uratani, Mishima (JP); Atsuhiko Ohmori, Suntou-gun (JP); Masaki Yamada, Mishima (JP); Minoru Ito, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/568,062

(22) Filed: Dec. 11, 2014

(65) Prior Publication Data

US 2015/0185655 A1 Jul. 2, 2015

(30) Foreign Application Priority Data

Dec. 26, 2013 (JP) ..... 2013-269663

(51) Int. Cl.
*G03G 15/08* (2006.01)
*G03G 9/08* (2006.01)
(Continued)

(52) U.S. Cl.
CPC ..... *G03G 15/0808* (2013.01); *G03G 9/0819* (2013.01); *G03G 9/0825* (2013.01);
(Continued)

(58) Field of Classification Search
CPC ..... G03G 15/0808; G03G 15/0818
USPC ..... 399/159, 286, 284; 430/123.3
See application file for complete search history.

(56) References Cited

U.S. PATENT DOCUMENTS 4,579,802 A * 4/1986 Kishi ..... G03G 15/2025 118/60
5,858,593 A * 1/1999 Tamura ..... G03G 9/0819 399/267

(Continued)

FOREIGN PATENT DOCUMENTS

JP 57-5047 A 1/1982
JP 2005-173484 A 6/2005

(Continued)

OTHER PUBLICATIONS

English language machine translation of JP 2012-181226 (Sep. 2012).*

(Continued)

*Primary Examiner* — Christopher Rodee
(74) *Attorney, Agent, or Firm* — Fitzpatrick, Cella, Harper & Scinto

(57) ABSTRACT

Provided is a developing apparatus, including toner for developing an electrostatic latent image, a toner carrier for carrying the toner, and a regulating member for regulating a layer thickness of the toner carried by the toner carrier. The toner carrier is placed to be brought into contact with the electrostatic latent image bearing member. The toner carrier includes a substrate, an elastic layer, and a surface layer containing a urethane resin. The urethane resin has a partial structure derived from a reaction between a compound represented by the structural formula (1) and a polyisocyanate. The toner contains toner particles each containing a binder resin and a magnetic material, and inorganic fine particles. The toner has a weight average particle diameter (D4) of from 9.5 μm to 14.0 μm. The toner has a porosity of 50 or more and 56 or less.

13 Claims, 4 Drawing Sheets

(51) Int. Cl.
*G03G 9/083* (2006.01)
*G03G 9/097* (2006.01)

(52) U.S. Cl.
CPC ..... *G03G9/0837* (2013.01); *G03G 9/09708* (2013.01); *G03G 15/0818* (2013.01); *G03G 15/0812* (2013.01)

(56) References Cited

U.S. PATENT DOCUMENTS

| | | | | |
|---|---|---|---|---|
| 7,239,831 | B2 | 7/2007 | Hagiwara et al. | |
| 7,361,442 | B2 | 4/2008 | Otake et al. | |
| 8,883,389 | B2 | 11/2014 | Matsui et al. | |
| 8,918,035 | B2 * | 12/2014 | Hasegawa | G03G 15/0812 399/274 |
| 2009/0130580 | A1 * | 5/2009 | Dojo | G03G 9/0819 430/106.1 |
| 2010/0080611 | A1 * | 4/2010 | Kurachi | G03G 15/0818 399/111 |
| 2013/0287454 | A1 * | 10/2013 | Anan | G03G 15/0818 399/286 |
| 2014/0064797 | A1 * | 3/2014 | Yamada | C08G 18/4825 399/286 |
| 2014/0093278 | A1 * | 4/2014 | Yamada | G03G 15/0818 399/111 |

FOREIGN PATENT DOCUMENTS

| | | | |
|---|---|---|---|
| JP | 2006-154093 | A | 6/2006 |
| JP | 2008007597 | A * | 1/2008 |
| JP | 2012181226 | A * | 9/2012 |

OTHER PUBLICATIONS

U.S. Appl. No. 14/573,375, filed Dec. 17, 2014. Inventor: Ito, et al.
U.S. Appl. No. 14/571,683, filed Dec. 16, 2014. Inventor: Wakabayashi, et al.
U.S. Appl. No. 14/568,061, filed Dec. 11, 2014. Inventor: Magome, et al.
U.S. Appl. No. 14/568,058, filed Dec. 11, 2014. Inventor: Matsui, et al.

* cited by examiner

IMAGE-FORMING APPARATUS, IMAGE-FORMING METHOD, DEVELOPING APPARATUS, AND DEVELOPING METHOD

BACKGROUND OF THE INVENTION

1. Field of the Invention

The present invention relates to an image-forming apparatus, an image-forming method, a developing apparatus, and a developing method each utilizing electrophotography.

2. Description of the Related Art

Although many methods have each been known as electrophotography, a general method is as described below. An electrostatic latent image is formed on an electrostatic image carrier with a photoconductive material by various units. Next, the electrostatic latent image is developed with toner to be turned into a visible image and the toner image is transferred onto a recording medium such as paper as required. After that, the toner image is fixed onto the recording medium by heat, a pressure, or the like to provide a copy. A copying machine, a printer, or the like is available as such image-forming apparatus.

The transition of such printer or copying machine from an analog system to a digital system has progressed in recent years, and hence the printer or the copying machine has been strongly required to have excellent latent image reproducibility and a high resolution. At the same time, the downsizing of, in particular, the printer has been strongly required.

The printer has heretofore been used in the following manner in many cases. The printer is connected to the network and many persons perform printing with the printer. However, a demand for the following manner has been growing in recent years. A PC and the printer are placed on an individual's desk, and the individual performs printing at hand. To this end, the space savings of the printer is necessary and hence the requirement for the downsizing of the printer has been strong.

In addition, even such compact printer has been strongly desired to have high image quality and such high durability that a variation in image quality is small even when the printer is used for a long time period.

Here, attention is paid to the downsizing of the printer. The downsizing of a fixing device and the downsizing of a developing apparatus are mainly effective for the downsizing. In particular, the latter accounts for a considerable portion of the volume of the printer and hence the downsizing of the developing apparatus can be said to be essential for the downsizing of the printer.

A development system is considered. A two-component development system or a one-component development system is available as the development system of the printer, but one-component development is suitable in a sense that a compact printer can be achieved. This is because no carrier is used.

Next, downsizing in the one-component development is considered. A reduction in diameter of an electrostatic latent image bearing member or a toner carrier is effective for the downsizing of the developing apparatus.

In addition, a cleaner-less system is extremely suitable for the downsizing of the developing apparatus. In many printers, toner on the electrostatic latent image bearing member remaining after a transferring step (hereinafter referred to as "transfer residual toner" or "residual toner") is scraped off by a cleaning blade or the like and recovered in a cleaner container. However, the cleaner-less system can significantly reduce the size of the developing apparatus because the system is free of the cleaning blade and the cleaner container.

Meanwhile, the cleaner-less system involves its own peculiar problems. One of the problems is the recoverability of the residual toner. In the cleaner-less system, the residual toner is recovered in the toner carrier in an area where the toner carrier and the electrostatic latent image bearing member abut with each other (hereinafter referred to as "development area"). However, when the recoverability of the residual toner is poor, the toner remains while being carried on the electrostatic latent image bearing member, which causes an image defect such as an increase in fog or a cleaner-less ghost. Here, the cleaner-less ghost is a phenomenon in which the residual toner after transfer is not recovered in a developing portion and is transferred in a following transferring step.

Attention is paid to the recoverability. In a low-temperature and low-humidity environment, the charge-up of the toner is liable to occur and the adhesive force of the toner to the electrostatic latent image bearing member increases. As a result, the recoverability of the residual toner tends to deteriorate.

To solve such problems, it has been reported that, for example, when a direct-current voltage is superimposed on an alternating voltage of a developing bias or the circularity and residual magnetization of the toner are controlled, even the cleaner-less system can maintain good image quality in a normal-temperature and normal-humidity environment (see Japanese Patent Application Laid-Open No. 2005-173484 and Japanese Patent Application Laid-Open No. 2006-154093).

However, even when such developing apparatus and toner are used, the recoverability in the low-temperature and low-humidity environment has been susceptible to improvement.

On the other hand, when the charge quantity of the toner is reduced for reducing the adhesive force between the toner and the electrostatic latent image bearing member with a view to improving the recoverability in the low-temperature and low-humidity environment, fog worsens particularly in a high-temperature and high-humidity environment. In general, fogging toner is hardly transferred because its charging polarity is opposite to regular charging polarity or its charge quantity is substantially zero. In addition, in the cleaner-less system, a mechanism for scraping off the residual toner such as a cleaning blade is absent and hence the residual toner contaminates a charging member. When the charging member is contaminated, the same potential as a preset one (potential on the electrostatic latent image bearing member) cannot be obtained and hence the fog tends to be additionally liable to increase.

As described above, in the cleaner-less system, it has been difficult to achieve compatibility between the recoverability of the residual toner in the low-temperature and low-humidity environment, and the suppression of the fog in the high-temperature and high-humidity environment, and hence the system has been susceptible to further improvement.

SUMMARY OF THE INVENTION

An object of the present invention is to provide a developing apparatus, a developing method, an image-forming apparatus, and an image-forming method each of which provides an image suppressed in fog even under a high-temperature and high-humidity environment, and provides good recoverability even under a low-temperature and low-humidity environment.

According to one embodiment of the present invention, there is provided an image-forming apparatus, including:

an electrostatic latent image bearing member;

a charging unit for charging a surface of the electrostatic latent image bearing member;

an image exposure unit for irradiating the charged surface of the electrostatic latent image bearing member with image exposure light to form an electrostatic latent image on the surface of the electrostatic latent image bearing member;

a developing apparatus for developing the electrostatic latent image formed on the surface of the electrostatic latent image bearing member to form a toner image on the surface of the electrostatic latent image bearing member;

a transferring unit for transferring the toner image formed on the surface of the electrostatic latent image bearing member onto a transfer material through or without through an intermediate transfer member; and a fixing unit for fixing the toner image transferred onto the transfer material onto the transfer material, the image-forming apparatus being configured to recover transfer residual toner on the surface of the electrostatic latent image bearing member after the transfer of the toner image with the developing apparatus, in which:

the developing apparatus includes toner for developing the electrostatic latent image, a toner carrier for carrying the toner, and a regulating member for regulating a layer thickness of the toner carried by the toner carrier;

the toner carrier is placed to be brought into contact with the electrostatic latent image bearing member;

the toner carrier includes a substrate, an elastic layer, and a surface layer containing a urethane resin;

the urethane resin has a partial structure derived from a reaction between a compound represented by the following structural formula (1) and a polyisocyanate;

the toner includes magnetic toner containing toner particles each containing a binder resin and a magnetic material, and inorganic fine particles;

the toner has a weight average particle diameter (D4) of 9.5 μm or more and 14.0 μm or less; and a porosity of the toner obtained from the following mathematical expression (1) is 50 or more and 56 or less:

$$\text{Porosity}=((\text{true density}-\text{tap density})/\text{true density})\times 100 \quad \text{Mathematical expression (1)}$$

Structural formula (1)

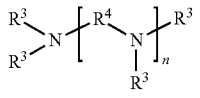

in the structural formula (1):

n represents an integer of 1 or more and 4 or less;

$R^3$'s each independently represent a group selected from the group consisting of the following (a) to (c):

(a) a hydroxyalkyl group having 2 or more and 8 or less carbon atoms, (b) an aminoalkyl group having 2 or more and 8 or less carbon atoms, and (c) a group represented by the following structural formula (2); and $R^4$ represents an alkylene group having 2 or more and 4 or less carbon atoms:

Structural formula (2)

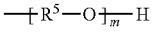

in the structural formula (2):

m is 2 or 3; and $R^5$ represents an alkylene group having 2 or more and 5 or less carbon atoms.

Further, according to one embodiment of the present invention, there is provided an image-forming method, including:

a charging step of charging a surface of an electrostatic latent image bearing member;

an image exposure step of irradiating the charged surface of the electrostatic latent image bearing member with image exposure light to form an electrostatic latent image on the surface of the electrostatic latent image bearing member;

a developing step of developing the electrostatic latent image formed on the surface of the electrostatic latent image bearing member with a developing apparatus to form a toner image on the surface of the electrostatic latent image bearing member;

a transferring step of transferring the toner image formed on the surface of the electrostatic latent image bearing member onto a transfer material through or without through an intermediate transfer member; and a fixing step of fixing the toner image transferred onto the transfer material onto the transfer material, the image-forming method including recovering transfer residual toner on the surface of the electrostatic latent image bearing member after the transfer of the toner image with the developing apparatus, in which:

the developing apparatus includes toner for developing the electrostatic latent image, a toner carrier for carrying the toner, and a regulating member for regulating a layer thickness of the toner carried by the toner carrier;

the toner carrier is placed to be brought into contact with the electrostatic latent image bearing member;

the toner carrier includes a substrate, an elastic layer, and a surface layer containing a urethane resin;

the urethane resin has a partial structure derived from a reaction between a compound represented by the structural formula (1) and a polyisocyanate;

the toner includes magnetic toner containing toner particles each containing a binder resin and a magnetic material, and inorganic fine particles;

the toner has a weight average particle diameter (D4) of 9.5 μm or more and 14.0 μm or less; and a porosity of the toner obtained from the mathematical expression (1) is 50 or more and 56 or less.

Further, according to one embodiment of the present invention, there is provided a developing apparatus for developing an electrostatic latent image formed on a surface of an electrostatic latent image bearing member to form a toner image on the surface of the electrostatic latent image bearing member, the developing apparatus including:

toner for developing the electrostatic latent image;

a toner carrier for carrying the toner; and a regulating member for regulating a layer thickness of the toner carried by the toner carrier, in which:

the toner carrier is placed to be brought into contact with the electrostatic latent image bearing member;

the toner carrier includes a substrate, an elastic layer, and a surface layer containing a urethane resin;

the urethane resin has a partial structure derived from a reaction between a compound represented by the structural formula (1) and a polyisocyanate;

the toner includes magnetic toner containing toner particles each containing a binder resin and a magnetic material, and inorganic fine particles;

the toner has a weight average particle diameter (D4) of 9.5 μm or more and 14.0 μm or less; and a porosity of the toner obtained from the mathematical expression (1) is 50 or more and 56 or less.

Further, according to one embodiment of the present invention, there is provided a developing method, including developing an electrostatic latent image formed on a surface of an electrostatic latent image bearing member with a developing apparatus to form a toner image on the surface of the electrostatic latent image bearing member, in which:

the developing apparatus includes toner for developing the electrostatic latent image, a toner carrier for carrying the toner, and a regulating member for regulating a layer thickness of the toner carried by the toner carrier;

the toner carrier is placed to be brought into contact with the electrostatic latent image bearing member;

the toner carrier includes a substrate, an elastic layer, and a surface layer containing a urethane resin;

the urethane resin has a partial structure derived from a reaction between a compound represented by the structural formula (1) and a polyisocyanate;

the toner includes magnetic toner containing toner particles each containing a binder resin and a magnetic material, and inorganic fine particles;

the toner has a weight average particle diameter (D4) of 9.5 μm or more and 14.0 μm or less; and a porosity of the toner obtained from the mathematical expression (1) is 50 or more and 56 or less.

According to embodiments of the present invention, it is possible to provide the developing apparatus, the developing method, the image-forming apparatus, and the image-forming method each of which provides an image suppressed in fog even under a high-temperature and high-humidity environment, and provides good recoverability even under a low-temperature and low-humidity environment.

Further features of the present invention will become apparent from the following description of exemplary embodiments with reference to the attached drawings.

DESCRIPTION OF THE EMBODIMENTS

Figure 1:
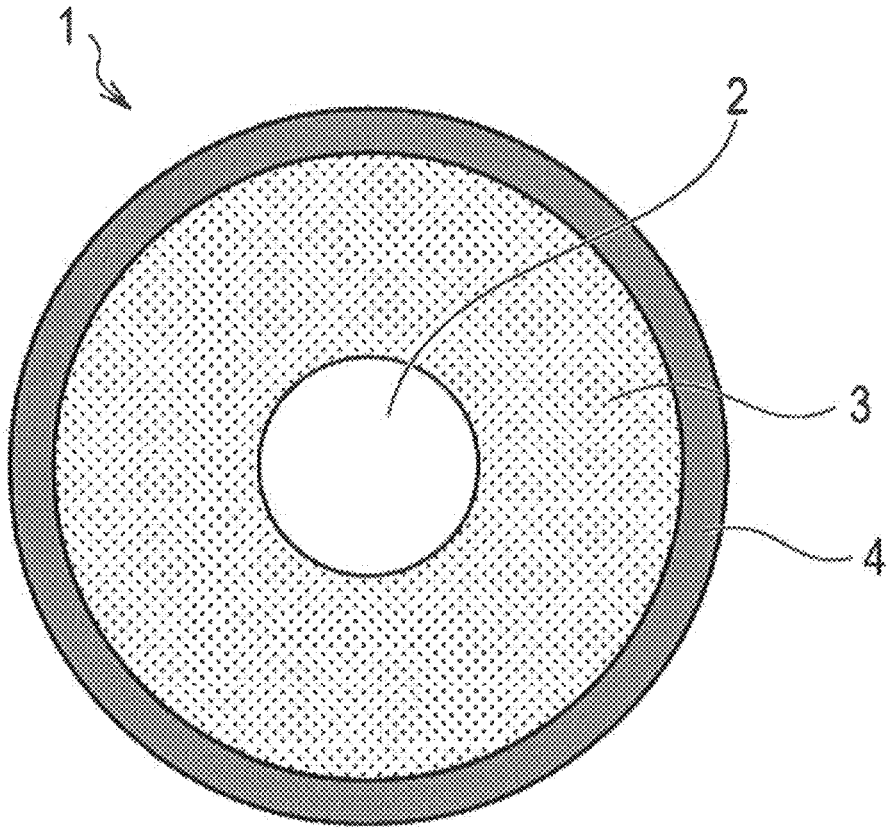
FIG. 1 is a schematic sectional view illustrating an example of a toner carrier according to the present invention.

Preferred Embodiments of the Present Invention will now be described in detail in accordance with the accompanying drawings.

A developing apparatus of the present invention is a developing apparatus for developing an electrostatic latent image formed on a surface of an electrostatic latent image bearing member to form a toner image on the surface of the electrostatic latent image bearing member, the developing apparatus including:

toner for developing the electrostatic latent image;

a toner carrier for carrying the toner; and a regulating member for regulating a layer thickness of the toner carried by the toner carrier, in which:

the toner carrier is placed to be brought into contact with the electrostatic latent image bearing member;

the toner carrier includes a substrate, an elastic layer, and a surface layer containing a urethane resin;

the urethane resin has a partial structure derived from a reaction between a compound represented by the following structural formula (1) and a polyisocyanate;

the toner includes magnetic toner containing toner particles each containing a binder resin and a magnetic material, and inorganic fine particles;

the toner has a weight average particle diameter (D4) of 9.5 μm or more and 14.0 μm or less; and a porosity of the toner obtained from the following mathematical expression (1) is 50 or more and 56 or less:

$$\text{Porosity}=((\text{true density}-\text{tap density})/\text{true density})\times 100 \qquad \text{Mathematical expression (1)}$$

Structural formula (1)

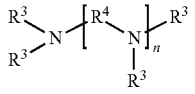

in the structural formula (1):

n represents an integer of 1 or more and 4 or less;

$R^3$'s each independently represent a group selected from the group consisting of the following (a) to (c):

(a) a hydroxyalkyl group having 2 or more and 8 or less carbon atoms, (b) an aminoalkyl group having 2 or more and 8 or less carbon atoms, and (c) a group represented by the following structural formula (2); and $R^4$ represents an alkylene group having 2 or more and 4 or less carbon atoms:

Structural formula (2)

$$-\!\!\left[R^5-O\right]_m\!\!-H$$

in the structural formula (2):

m is 2 or 3; and $R^5$ represents an alkylene group having 2 or more and 5 or less carbon atoms.

Detailed studies made by the inventors of the present invention have found that the use of a toner carrier containing a specific urethane resin in its surface layer, and toner having a specific weight average particle diameter (D4) and a specific porosity can achieve compatibility between the suppression of fog in a high-temperature and high-humidity environment, and recoverability of the toner in a low-temperature and low-humidity environment. Thus, the inventors have reached the present invention.

The reason for the foregoing is described below.

First, it is important that the toner be rapidly charged in order that the fog may be suppressed in the high-temperature and high-humidity environment where the toner is hardly charged. As described in the foregoing, in a cleaner-less system, the fog worsens as compared with that in a conventional system having a cleaner owing to the contamination of a charging member, and hence a requirement for the suppression of the fog has become strict.

With regard to the fog in the high-temperature and high-humidity environment, the following two conditions may be necessary for obtaining uniform chargeability in the high-temperature and high-humidity environment where the toner is hardly charged. One condition is that the chargeability of a member is high, and the other condition is that the toner has many opportunities to be charged. With regard to the first condition, i.e., the chargeability of the member, the toner can be charged by being brought into contact with the toner carrier and being rubbed with the carrier. In view of the foregoing, the inventors have made various studies on a compound to be incorporated into the surface layer of the toner carrier, and as a result, have found that a urethane resin having a partial structure derived from a reaction between a compound represented by the structural formula (1) and a polyisocyanate has a high charging ability. The reason for the foregoing is as described below. The compound represented by the structural formula (1) has a nitrogen atom (N) at its center and the nitrogen atom has a lone pair, and hence the compound represented by the structural formula (1) is a Lewis base. The Lewis base is electron donative, and hence bringing the toner into contact with the urethane resin having the partial structure derived from the reaction between the compound represented by the structural formula (1) and the polyisocyanate can provide a sufficient charge quantity. In addition, the reaction between the compound represented by the structural formula (1) and the isocyanate, results in the formation of such a crosslinked structure that many urethane groups or urea groups are produced around the structure of the compound represented by the structural formula (1). As a result, the microscopic hardness of the compound increases, and hence the toner seldom caves in the surface of the toner carrier even upon regulation of the toner in a portion where a toner-regulating member and the toner carrier abut with each other (hereinafter abbreviated as "regulating portion"). As a result, good rolling property of the toner can be maintained and hence chargeability to the toner improves.

Next, the behavior of the toner on the toner carrier is considered. The toner is conveyed by the toner carrier, and in the regulating portion, such a force that the toner is conveyed by the toner carrier and a force by a pressing force from a regulating blade act on the toner. As a result, the toner on the surface of the toner carrier is conveyed while being replaced like being mixed. In addition, when the toner is rolled and replaced in the regulating portion, the toner is brought into contact with the toner carrier and rubbed with the carrier. Thus, the toner is charged to be provided with charge.

What is important here is that the toner is rolled and replaced in the regulating portion. However, in an abutting portion, the toner is compressed by the pressing force from the regulating blade to be brought into a packed state. When the toner is densely packed in the regulating portion, the movement of the toner is regulated, and hence its good rolling property and good replacement performance are limited. Accordingly, it may be important that the toner have some pores when compressed.

By the foregoing reason, it is important that a porosity upon compression of the toner, i.e., a porosity represented by the mathematical expression (1) be 50 or more and 56 or less.

The case where the porosity of the toner is less than 50 is not preferred because the porosity of the compressed toner is low, the rolling property or replacement performance of the toner is liable to be insufficient in the regulating portion, and its rapid charging is impaired. In addition, in the case where the amount of the fine powder of the toner is large or in the case where the flowability of the toner is poor, the porosity is liable to be more than 56. Any such case is also not preferred because the fog is liable to increase owing to an influence of the fine powder or the poor flowability.

It should be noted that as represented by the mathematical expression (1), the porosity is determined by dividing a difference between the true density and tap density of the toner by the true density, and represents the ratio of pores present between the particles of the toner upon tapping of the toner. The reason why the porosity upon tapping of the toner is the compression of the toner in the regulating portion as descried in the foregoing. Accordingly, it is assumed that the tapped toner can be approximated to the compressed state in the regulating portion.

The porosity of the toner can be controlled by adjusting the particle diameter or shape of the toner, the kind or amount of an external additive, or a production condition at the time of an external addition step.

As described so far, the toner carrier to be used in the present invention contains, in its surface layer, the urethane resin having the partial structure derived from the reaction between the compound represented by the structural formula (1) and the polyisocyanate, and hence has high chargeability; in addition, the toner has a moderate porosity and hence can obtain many opportunities to be charged. By virtue of a synergistic effect between those two points, even in the high-temperature and high-humidity environment where the toner is hardly charged, rapid and high chargeability can be obtained, and the fog can be suppressed.

Next, the recoverability in the low-temperature and low-humidity environment is described. The following facts may be important for improving the recoverability: the adhesive force of the toner to an electrostatic latent image bearing member is low; and the toner has proper chargeability in a development area, and residual toner (transfer residual toner) and the toner on the toner carrier are replaced with each other. The reason for the foregoing is described below.

When the adhesive force of the toner to the electrostatic latent image bearing member is high, the toner adheres to the electrostatic latent image bearing member and hence the recoverability becomes poor. In addition, in the cleaner-less system, both the toner on the toner carrier and the residual toner mix with each other like being replaced with each other, whereby the residual toner is recovered.

In view of the foregoing, attention is paid to the adhesive force. The adhesive force is the sum of a non-electrostatic force (Van der Waals force) and an electrostatic force (reflection force). Accordingly, it is important to reduce both the Van der Waals force and the reflection force.

First, the Van der Waals force is described. As a toner particle diameter increases, the area of contact between the toner and the electrostatic latent image bearing member reduces, and hence the Van der Waals force reduces. Accordingly, it is important that the weight average particle diameter (D4) of the toner to be used in the present invention be 9.5 μm or more and 14.0 μm or less.

Next, the reflection force is described. The toner carrier to be used in the present invention contains, in its surface layer, the urethane resin having the partial structure derived from the reaction between the compound represented by the structural formula (1) and the polyisocyanate, and hence can obtain rapid chargeability. The same holds true for the low-temperature and low-humidity environment, but on the other hand, the toner can be said to be in a state where its charge-up is liable to occur.

However, the toner to be used in the present invention has a porosity of 50 or more as described above, and hence the toner is hardly compressed in the regulating portion, and the good rolling property and good replacement performance of the toner can be maintained. Further, the weight average particle diameter (D4) of the toner to be used in the present invention is as large as 9.5 μm or more, and hence its specific surface area is smaller than that of a small-diameter toner and the quantity of electric charge of the toner reduces. Accordingly, by virtue of a synergistic effect between the fact that the rolling property and replacement performance of the toner in the regulating portion are good, and the fact that the quantity of electric charge of the toner reduces, even in the low-temperature and low-humidity environment, the charge-up does not occur and the reflection force can be reduced.

As described above, the Van der Waals force and reflection force of the toner to be used in the present invention are low, and hence the adhesive force can be reduced.

Next, the behavior of the toner in the development area is considered. As described in the foregoing, it is important that the toner on the toner carrier and the residual toner be replaced with each other in order that the residual toner may be recovered. The rolling property and replacement performance of the toner in the regulating portion have been described so far, but the same may hold true for the development area.

That is, in the case of the toner to be used in the present invention, the rolling property and replacement performance of the toner on the toner carrier are good in the development area as well. In addition, the adhesive force of the toner is low, and hence the residual toner easily mixes with the toner on the toner carrier in the development area. Further, the residual toner may have various kinds of chargeability, but when the residual toner mixes with the toner on the toner carrier in the development area, and is brought into contact with the toner carrier to be used in the present invention containing a specific compound and rubbed with the carrier, the residual toner can have the same chargeability as that of the toner on the toner carrier.

By such reasons, in the present invention, good recoverability can be maintained even in the low-temperature and low-humidity environment where the recoverability is liable to deteriorate, and the fog can be suppressed in the high-temperature and high-humidity environment.

The toner to be used in the present invention has a ratio D4/D1 of its weight average particle diameter (D4) to its number average particle diameter (D1) of preferably 1.30 or less, more preferably 1.25 or less. The case where the ratio D4/D1 is 1.30 or less means that the particle size distribution of the toner is sharp.

As described so far, it is important that the adhesive force of the toner to be used in the present invention be low. The adhesive force depends on the particle diameter of the toner as well. As the particle diameter reduces, the adhesive force increases, and as the particle diameter increases, the adhesive force reduces. Accordingly, the particle size distribution is preferably sharp because a variation in adhesive force between toner particles reduces and hence the replacement performance of the toner in the regulating portion easily becomes good. Further, the weight average particle diameter (D4) of the toner to be used in the present invention is 9.5 μm or more and 14.0 μm or less. Accordingly, the case where the ratio D4/D1 is 1.30 or less is extremely preferred because the case means that the amount of fine powder is small, and hence the fog is alleviated.

The glass transition temperature (Tg) of the toner to be used in the present invention is preferably 40.0° C. or more and 70.0° C. or less. The glass transition temperature preferably falls within the range because the storage stability and durability of the toner can be improved while its good fixability is maintained.

Although examples of the binder resin of the toner to be used in the present invention include a vinyl-based resin and a polyester-based resin, the resin is not particularly limited thereto and a conventionally known resin can be used.

Specific examples of the binder resin that can be used include: homopolymers of styrene and substituted derivatives thereof, such as polystyrene and polyvinyl toluene; styrene-based copolymers such as a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleic acid ester copolymer; and polymethyl methacrylate, polybutyl methacrylate, polyvinyl acetate, polyethylene, polypropylene, polyvinylbutyral, a polyester resin, a polyamide resin, an epoxy resin, and a polyacrylic acid resin. One kind of those resins may be used alone, or two or more kinds thereof may be used in combination. Of those, a styrene-based copolymer and a polyester resin are particularly preferred in terms of, for example, developing characteristic and fixability.

In the toner to be used in the present invention, in order to improve charging characteristics, a charge control agent may be blended as required. A known agent can be utilized as the charge control agent, and a charge control agent having the following characteristics is particularly preferred: the agent can be charged at a high speed, and can stably maintain a certain charge quantity. Specific examples of the charge control agent include: metal compounds of aromatic carboxylic acids such as salicylic acid, an alkylsalicylic acid, a dialkylsalicylic acid, naphthoic acid, and dicarboxylic acids; metal salts and metal complexes of azo dyes and azo pigments; polymer compounds each having a sulphonic acid group or carboxylic acid group in a side chain; boron compounds; urea compounds; silicon compounds; and calixarenes.

The usage of such charge control agent is determined by the kind of the binder resin, the presence or absence of any other additive, and the production method for the toner including a dispersion method, and is hence not uniquely limited. However, when the charge control agent is internally added to each toner particle, the charge control agent is used in an amount in the range of preferably from 0.1 part by mass or more to 10.0 parts by mass or less, more preferably from 0.1 part by mass or more to 5.0 parts by mass or less with respect to 100 parts by mass of the binder resin. In addition, when the charge control agent is externally added to each toner particle, the usage is preferably 0.005 part by mass or more and 1.000 part by mass or less, more preferably 0.010 part by mass or more and 0.300 part by mass or less with respect to 100 parts by mass of the toner.

The toner to be used in the present invention may contain a release agent for an improvement in its fixability, and the content of the release agent is preferably 1.0 mass % or more and 30.0 mass % or less, more preferably 3.0 mass % or more and 25.0 mass % or less with respect to the binder resin.

A content of the release agent of less than 1.0 mass % is not preferred because a low temperature offset-suppressing effect is poor. A content of the release agent of more than 30.0 mass % is not preferred because the long-term storage stability of the toner deteriorates, and the charging uniformity of the toner becomes poor owing to, for example, the exudation of the release agent to the surface of the toner and hence a regulation failure is liable to worsen.

Examples of the release agent that may be used for the toner to be used in the present invention include: petroleum-based wax such as paraffin wax, microcrystalline wax, or petro-lactam and derivatives thereof; montan wax and derivatives thereof; hydrocarbon wax obtained by the Fischer Tropsch process and derivatives thereof; polyolefin wax typified by polyethylene and derivatives thereof; and natural wax such as carnauba wax or candelilla wax and derivatives thereof. The derivatives include an oxide, and a block copolymer or graft-modified product with a vinyl-based monomer. Further, there may also be used, for example, a higher aliphatic alcohol, a fatty acid such as stearic acid or palmitic acid, acid amide wax, ester wax, hydrogenated castor oil and a derivative thereof, vegetable wax, and animal wax.

In addition, the melting point of any such release agent specified by the highest endothermic peak temperature at the time of temperature increase measured with a differential scanning calorimeter (DSC) is preferably 60° C. or more and 140° C. or less, more preferably 65° C. or more and 120° C. or less. The case where the melting point is 60° C. or less is not preferred because the viscosity of the toner is liable to reduce and hence its fusion to the toner carrier is liable to occur. On the other hand, the case where the melting point is 140° C. or more is not preferred because the low-temperature fixability of the toner is liable to deteriorate.

The melting point of the release agent is defined as the peak top of its endothermic peak upon measurement with the DSC. The measurement of the peak top of the endothermic peak is performed in conformity with ASTM D 3417-99. For example, a DSC-7 manufactured by PerkinElmer, Inc., a DSC2920 manufactured by TA Instruments, or a Q1000 manufactured by TA Instruments can be used in such measurement. The melting points of indium and zinc are used for the temperature correction of the detecting portion of any such apparatus, and the heat of fusion of indium is used for the correction of a heat quantity. In the measurement, a pan made of aluminum is used for a measurement sample and an empty pan is set for reference.

The toner to be used in the present invention contains a magnetic material, and the content of the magnetic material is preferably 20 parts by mass or more and 150 parts by mass or less with respect to 100 parts by mass of the binder resin.

It should be noted that the content of the magnetic material in the toner can be measured with a thermal analyzer TGA7 manufactured by PerkinElmer, Inc. A method for the measurement is as described below. Under a nitrogen atmosphere, the toner is heated from normal temperature to 900° C. at a rate of temperature increase of 25° C./min. The loss (mass %) in the range of from 100° C. to 750° C. is defined as the amount of the binder resin, and the remaining mass is approximately defined as the amount of the magnetic material.

The magnetic material uses a magnetic iron oxide such as triiron tetraoxide or γ-iron oxide as a main component, and may contain an atom of, for example, phosphorus, cobalt, nickel, copper, magnesium, manganese, aluminum, or silicon. Any such magnetic material has a BET specific surface area determined by a nitrogen adsorption method of preferably 2 $m^2/g$ or more and 30 $m^2/g$ or less, more preferably 3 $m^2/g$ or more and 28 $m^2/g$ or less. The shape of the magnetic material is, for example, a polyhedral shape, an octahedral shape, a hexahedral shape, a spherical shape, a needle shape, or a scaly shape. The magnetic material preferably has a shape with a low degree of anisotropy, such as a polyhedral shape, an octahedral shape, a hexahedral shape, or a spherical shape in order to increase an image density.

The magnetic material preferably has a volume average particle diameter (D3) of 0.10 μm or more and 0.40 μm or less. The case where the volume average particle diameter (D3) of the magnetic material falls within the range is preferred because the dispersibility of the magnetic material is improved and the coloring power of the toner is improved.

It should be noted that the volume average particle diameter (D3) of the magnetic material can be measured with a transmission electron microscope. Specifically, the toner particles to be observed are sufficiently dispersed in an epoxy resin, and then the resultant is cured in an atmosphere having a temperature of 40° C. for 2 days so that a cured product may be obtained. The resultant cured product is turned into a flaky sample with a microtome, and then the sample is photographed with a transmission electron microscope (TEM) at a magnification of from 10,000 to 40,000. The diameters of 100 magnetic material particles in the field of view of the photograph are measured. Then, the volume average particle diameter (D3) is calculated based on the equivalent diameter of a circle equal in area to the projected area of the magnetic material. Alternatively, the particle diameters can be measured with an image analyzer.

The magnetic material can be produced by, for example, the following method. An alkali such as sodium hydroxide is added to an aqueous solution of a ferrous salt in an equivalent or more with respect to the iron component so that an aqueous solution containing ferrous hydroxide may be prepared. While the pH value of the prepared aqueous solution is maintained at a pH 7 or more, air is blown into the aqueous solution. Then, the oxidation reaction of ferrous hydroxide is performed while the aqueous solution is heated to 70° C. or more. Thus, a seed crystal serving as the core of magnetic iron oxide powder is produced first.

Next, an aqueous solution containing one equivalent of ferrous sulfate with reference to the addition amount of the alkali previously added is added to the slurry-like liquid containing the seed crystal. While the pH value of the resultant liquid is maintained at pH 5 or more and pH 10 or less, air is blown into the liquid. During the blowing, the reaction of ferrous hydroxide is advanced so that the magnetic iron oxide powder may be grown with the seed crystal as a core. At this time, the shape and magnetic characteristics of the magnetic material can be controlled by selecting an arbitrary pH value, an arbitrary reaction temperature, and an arbitrary agitation condition. As the oxidation reaction progresses, the pH value of the liquid shifts to acidic values. However, the pH value of the liquid is preferably prevented from becoming less than pH 5. The magnetic material thus obtained is filtrated, washed, and dried by ordinary methods. Thus, the magnetic material can be obtained.

In the present invention, a coloring agent other than the magnetic material may be used together. Examples of the coloring agent that can be used together include, in addition to known dyes and pigments, magnetic or non-magnetic inorganic compounds. Specific examples thereof include ferromagnetic metal particles such as cobalt and nickel, alloys thereof obtained by adding chromium, manganese, copper, zinc, aluminum, rare-earth elements, and the like thereto, particles such as hematite, titanium black and nigrosine dyes/pigments, carbon black, and phthalocyanine. Those are also preferably used after being subjected to surface hydrophobic treatment.

The toner to be used in the present invention can be produced by any one of the known methods. When the toner is produced by a pulverization method, components needed for the toner such as the binder resin, the coloring agent, and the release agent, any other additive, and the like are sufficiently mixed with a mixer such as a Henschel mixer or a ball mill. After that, the mixture is melted and kneaded with a heat kneader such as a heat roll, a kneader, or an extruder so that the toner materials may be dispersed or dissolved. Then, the resultant is cooled to solidify and pulverized. After that, the pulverized products are classified, and as required, subjected to surface treatment. Thus, the toner particles can be obtained. It does not matter which one of the classification and the surface treatment is performed prior to the other. In the classifying step, a multi-division classifier is preferably used in terms of production efficiency.

The pulverizing step can be performed by a method involving using a known pulverizing apparatus such as a mechanical impact type or jet type pulverizing apparatus. Further, it is preferred that the pulverization be performed while applying heat or treatment involving applying a mechanical impact in an auxiliary fashion be performed. Alternatively, a hot water bath method involving dispersing finely pulverized toner particles (classified as required) in hot water, a method involving passing the particles through a heat air current, or the like may be employed.

For example, a method involving using a mechanical impact type pulverizer such as a Kryptron system manufactured by Kawasaki Heavy Industries or a Turbo mill manufactured by Turbo Kogyo Co., Ltd. is given as a method of applying a mechanical impact force. Also given is a method involving pressing the toner against the inside of a casing with a blade rotating at a high speed by means of a centrifugal force and applying a mechanical impact force to the toner like an apparatus such as a Mechanofusion System manufactured by Hosokawa Micron Corporation.

It is necessary that inorganic fine particles having a number average particle diameter (D1) of primary particles of preferably 4 nm or more and 80 nm or less, more preferably 6 nm or more and 40 nm or less be added to the toner particles of the toner to be used in the present invention. The inorganic fine particles are added for improving the flowability of the toner and uniformizing the charging of the toner particles. It is also preferred that functions such as the adjustment of the charge quantity of the toner and an improvement in its environmental stability be imparted by subjecting the inorganic fine particles to treatment such as hydrophobic treatment.

In the present invention, the measurement of the number average particle diameter (D1) of primary particles of the inorganic fine particles is performed with a photograph of the toner photographed with a scanning electron microscope at a certain magnification.

Silica, titanium oxide, alumina, or the like can be used as the inorganic fine particles to be used in the present invention. For example, both dry silica, which is so-called dry process silica or fumed silica, produced by the vapor phase oxidation of a silicon halide and the so-called wet silica produced from water glass and the like can each be used as the silica fine particles. However, the dry silica is preferred because the number of silanol groups present on its surface and in the silica fine particles is small, and the amount of a production residue such as $Na_2O$ or $SO_3^{2-}$ is small.

The addition amount of the inorganic fine particles is preferably 0.1 part by mass or more and 3.0 parts by mass or less with respect to 100 parts by mass of the toner particles. The content of the inorganic fine particles can be determined with a calibration curve created from a standard sample by employing fluorescent X-ray analysis.

In the present invention, the inorganic fine particles are preferably subjected to hydrophobic treatment because the environmental stability of the toner can be improved. As a treatment agent to be used in the hydrophobic treatment of the inorganic fine particles, there are given, for example, a silicone varnish, various modified silicone varnishes, a silicone oil, various modified silicone oils, a silane compound, a silane coupling agent, and other organosilicon compounds and organic titanium compounds. One kind of those treatment agents may be used alone, or two or more kinds thereof may be used in combination.

The toner to be used in the present invention preferably contains fine particles having a number average particle diameter (D1) of primary particles of 100 nm or more and 2.0 μm or less. In addition, the fine particles are preferably at least one kind of fine particles selected from the group consisting of resin fine particles, strontium titanate fine particles, barium titanate fine particles, and calcium titanate fine particles. The addition of such fine particles improves the rolling property and replacement performance of the toner in the regulating portion. This is based on a synergistic effect between: the fact that the number average particle diameter (D1) of the primary particles is as large as 100 nm or more and 2.0 μm or less, and hence the adhesive force of the toner reduces; and the fact that these fine particles are substantially free from being charged and hence the charge-up of the toner is suppressed.

The resin fine particles are preferably resin fine particles using a methacrylate as a main component, resin fine particles using an acrylate as a main component, or resin fine particles using styrene and a styrene derivative as main components. It should be noted that the definition of the term "main component" is as follows: the component accounts for 60 mass % or more of the amount of all components.

Examples of a polymerizable monomer to be used for those resin fine particles include: styrene-based monomers such as styrene, o-methylstyrene, m-methylstyrene, p-methylstyrene, p-methoxystyrene, and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and other monomers such as acrylonitrile, methacrylonitrile, and acrylamide. One kind of those monomers may be used alone, or two or more kinds thereof may be used as a mixture.

The addition amount of the fine particles is preferably 0.1 part by mass or more and 3.0 parts by mass or less with respect to 100 parts by mass of the toner particles. An addition amount of the fine particles of 0.1 part by mass or more and 3.0 parts by mass or less is extremely preferred because the effect is easily exhibited.

Next, the toner carrier to be used in the present invention is described.

The toner carrier to be used in the present invention includes a substrate, an elastic layer, and a surface layer containing a urethane resin, and the urethane resin has a partial structure derived from a reaction between a compound represented by the structural formula (1) and a polyisocyanate.

FIG. 1 illustrates a toner carrier according to one embodiment of the present invention. A conductive roller 1 (toner carrier) illustrated in FIG. 1 is obtained by forming an elastic layer 3 on the outer peripheral surface of a columnar or hollow cylindrical conductive substrate 2. In addition, a surface layer 4 covers the outer peripheral surface of the elastic layer 3.

<Substrate>

The substrate 2 functions as an electrode and support member for the conductive roller 1, and is constituted of a conductive material such as: a metal or an alloy like aluminum, a copper alloy, or stainless steel; iron subjected to plating treatment with chromium or nickel; or a synthetic resin having conductivity.

<Elastic Layer>

The elastic layer 3 imparts, to the conductive roller, elasticity needed for forming an abutting portion having a predetermined width in an abutting portion between the conductive roller and the electrostatic latent image bearing member.

It is generally preferred that the elastic layer 3 be formed of a molded product of a rubber material. Examples of the rubber material include an ethylene-propylene-diene copolymerized rubber (EPDM), an acrylonitrile-butadiene rubber (NBR), a chloroprene rubber (CR), a natural rubber (NR), an isoprene rubber (IR), a styrene-butadiene rubber (SBR), a fluororubber, a silicone rubber, an epichlorohydrin rubber, a hydrogenated product of NBR, and a urethane rubber. One kind of those materials may be used alone, or two or more kinds thereof may be used as a mixture.

Of those, a silicone rubber is particularly preferred because a compression set hardly occurs in the elastic layer even when any other member (such as a developer-regulating blade) abuts therewith over a long time period. The silicone rubber is, for example, a cured product of an addition-curable silicone rubber. Moreover, a cured product of an addition-curable dimethyl silicone rubber is particularly preferred because of its excellent adhesive property to the surface layer to be described later.

Various additives such as a conductivity-imparting agent, a nonconductive filler, a crosslinking agent, and a catalyst are each appropriately blended into the elastic layer 3. Fine particles of carbon black, of a conductive metal such as aluminum or copper, or of a conductive metal oxide such as zinc oxide, tin oxide, or titanium oxide can be used as the conductivity-imparting agent. Of those, carbon black is particularly preferred because the carbon black is relatively easily available and provides good conductivity. When the carbon black is used as the conductivity-imparting agent, the carbon black is blended in an amount of from 2 to 50 parts by mass with respect to 100 parts by mass of the rubber in the rubber material. Examples of the nonconductive filler include silica, quartz powder, titanium oxide, zinc oxide, and calcium carbonate. Examples of the crosslinking agent include di-t-butyl peroxide, 2,5-dimethyl-2,5-di(t-butylperoxy)hexane, and dicumyl peroxide. An example of the catalyst is a known catalyst that is generally used.

<Surface Layer>

The surface layer 4 is a resin layer using a urethane resin as a main component, and the urethane resin is obtained by a reaction between a polyol and a polyisocyanate, and can be synthesized as described below.

First, a polyol component such as a polyether polyol or a polyester polyol and the polyisocyanate are caused to react with each other to provide an isocyanate group-terminated prepolymer.

Next, the isocyanate group-terminated prepolymer is caused to react with a compound having a structure represented by the structural formula (1), whereby the urethane resin according to the present invention can be obtained.

Examples of the polyether polyol include polyethylene glycol, polypropylene glycol, and polytetramethylene glycol. Examples of the polyester polyol include polyester polyols each obtained by a condensation reaction of a diol component such as 1,4-butanediol, 3-methyl-1,4-pentanediol, or neopentyl glycol, a triol component such as trimethylolpropane, and a dicarboxylic acid such as adipic acid, phthalic anhydride, terephthalic acid, or hexahydroxyphthalic acid.

In addition to those described above, examples of the polyol component include a polyolefin polyol such as polybutadiene polyol or polyisoprene polyol and a hydrogenated product thereof, and polycarbonate polyol.

The polyol component may be formed in advance into a prepolymer through chain extension with an isocyanate such as 2,4-tolylene diisocyanate (TDI), 1,4-diphenylmethane diisocyanate (MDI), or isophorone diisocyanate (IPDI) as required.

The number average molecular weight of each of the polyether polyol and the polyester polyol is particularly preferably 1,000 or more and 4,000 or less. When the number average molecular weight of any such polyol falls within the range, the amount of a hydroxyl group with respect to the molecular weight is large, and hence the polyol shows high reactivity with the isocyanate and the amount of an unreacted component reduces. Accordingly, the chargeability of the toner carrier in a high-temperature and high-humidity environment becomes additionally good.

The isocyanate compound to be caused to react with the polyol component and the compound represented by the structural formula (1) is not particularly limited and there may be used: aliphatic polyisocyanates such as ethylene diisocyante and 1,6-hexamethylene diisocyante (HDI); alicyclic polyisocyanates such as isophorone diisocyanate (IPDI), cyclohexane 1,3-diisocyanate, and cyclohexane 1,4-diisocyanate; aromatic isocyanates such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate, and naphthalene diisocyanate; and copolymers thereof, isocyanurates thereof, TMP adducts thereof, biuret compounds thereof, and blocked compounds thereof.

Of those, there are more suitably used aromatic isocyanates such as tolylene diisocyanate, diphenylmethane diisocyanate, and polymeric diphenylmethane diisocyanate.

The mixing ratio of the isocyanate compound to be caused to react with the polyol component and the compound represented by the structural formula (1) in terms of an isocyanate group ratio preferably falls within the range of from 1.0 to 2.0 with respect to 1.0 of a hydroxyl group of each of the polyol component and the compound.

The surface layer of the toner carrier to be used in the present invention contains a urethane resin having a partial structure derived from a reaction between a compound represented by the structural formula (1) and a polyisocyanate. As described so far, the use of the urethane resin can maintain the good rolling property of the toner and can impart high chargeability to the toner.

Structural formula (1)

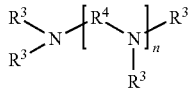

The compound represented by the structural formula (1) is described in detail. The compound represented by the structural formula (1) represents a polyfunctional polyol or terminal amino compound having an amine structure in a molecule thereof. When n represents 1 or more and 4 or less, i.e., when the compound has a structure having 4 or more and 7 or less hydroxyl groups or amino groups as reactive functional groups, a crosslinked structure based on a urethane group or a urea group is satisfactorily formed, and hence the microscopic hardness of the compound increases. As a result, the good rolling property of the toner can be maintained.

Next, according to studies made by the inventors of the present invention, the effect is exhibited when the number of the hydroxyl groups or amino groups of the compound represented by the structural formula (1) is 4 or more and 7 or less. Accordingly, the number of the terminal functional groups of the compound represented by the structural formula (1) only needs to be at least 4, and the same effect is obtained even when the other groups are substituted with alkyl groups.

In the structural formula (1), $R^3$'s each independently represent a group selected from the group consisting of the following (a) to (c):

(a) a hydroxyalkyl group having 2 or more and 8 or less carbon atoms, (b) an aminoalkyl group having 2 or more and 8 or less carbon atoms, and (c) a group represented by the structural formula (2).

When $R^3$ represents a hydroxyalkyl group, the number of its carbon atoms is preferably 1 or more and 8 or less, and when $R^3$ represents an aminoalkyl group, the number of its carbon atoms is preferably 2 or more and 8 or less because the crosslinked structure based on a urethane or urea group is easily formed.

The structural formula (2) represents a group whose terminal is a hydroxyl group, the group having the so-called ether repeating unit. In the case where $R^3$ represents a group represented by the structural formula (2) as well, by the same reason, it is preferred that $R^5$ represent an alkylene group having 2 or more and 5 or less carbon atoms, and an ether repetition number m represent 2 or more and 3 or less.

Structural formula (2)

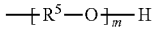

In the structural formula (1), $R^4$ preferably represents an alkylene group having 2 or more and 4 or less carbon atoms. In the case of an alkylene group having 2 or more and 4 or less carbon atoms, the chargeability of the toner carrier improves. This is probably because when $R^4$ represents the alkylene group having 2 or more and 4 or less carbon atoms, a molecule of the compound has a moderate size and hence its dispersibility at the time of its reaction with the isocyanate becomes good.

Of the compounds represented by the structural formula (1), a compound represented by the structural formula (3) is preferred. That is, it is particularly preferred that in the structural formula (1), n represent 1 or 2, $R^3$'s each independently represent an alkylene group having 2 or 3 carbon atoms, and $R^4$ represent an alkylene group having 2 carbon atoms.

A urethane resin including a partial structure derived from the structural formula (3) is particularly preferred because a functional group value (pentafunctional) and a distance between urethane groups fall within the most suitable ranges, and hence the rolling property of the toner in the regulating portion becomes good.

Structural formula (3)

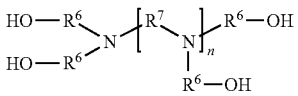

In the structural formula (3), n represents 1 or 2, $R^6$'s each independently represent an alkylene group having 2 or 3 carbon atoms, and $R^7$ represents an alkylene group having 2 carbon atoms.

It should be noted that in the present invention, when $R^3$ represents (a) a hydroxyalkyl group having 2 or more and 8 or less carbon atoms, or (c) a group represented by the structural formula (2), the structure formed by the reaction between the compound represented by the structural formula (1) and the polyisocyanate becomes a structure having a urethane group at a terminal of the structural formula (1).

In addition, when $R^3$ represents (b) an aminoalkyl group having 1 or more and 8 or less carbon atoms, the structure becomes a structure having a urea group at a terminal of the structural formula (1).

The surface layer 4 preferably has conductivity. A method of imparting the conductivity is, for example, the addition of an ion conductive agent or conductive fine particles. Of those, conductive fine particles that are available at a low cost and show a small variation in resistance due to an environment are suitably used, and carbon black is particularly preferred from the viewpoints of conductivity-imparting property and reinforcing property. With regard to the properties of the conductive fine particles, carbon black having a primary particle diameter of 18 nm or more and 50 nm or less, and a DBP oil absorption of 50 mL/100 g or more and 160 mL/100 g or less is preferred because a balance among its conductivity, hardness, and dispersibility is good. The content of the conductive fine particles is preferably 10 mass % or more and 30 mass % or less with respect to 100 parts by mass of the resin component forming the surface layer.

When the toner carrier is required to have a surface roughness, fine particles for roughness control may be added to the surface layer 4. The fine particles for roughness control preferably have a volume average particle diameter of from 3 to 20 μm. In addition, the addition amount of the particles to be added to the surface layer is preferably from 1 to 50 parts by mass with respect to 100 parts by mass of the resin solid content of the surface layer. Fine particles of a polyurethane resin, a polyester resin, a polyether resin, a polyamide resin, an acrylic resin, or a phenol resin can be used as the fine particles for roughness control.

A method of forming the surface layer 4 is, for example, but not particularly limited to, spray coating, dip coating, or roll coating with a paint. As a method of forming the surface layer, such a dip coating method involving overflowing the paint from the upper end of a dipping tank as described in Japanese Patent Application Laid-Open No. S57-5047 is simple and excellent in production stability.

Next, a developing apparatus of the present invention is described in detail with reference to the drawings, but the present invention is not limited thereto.

Figure 2:
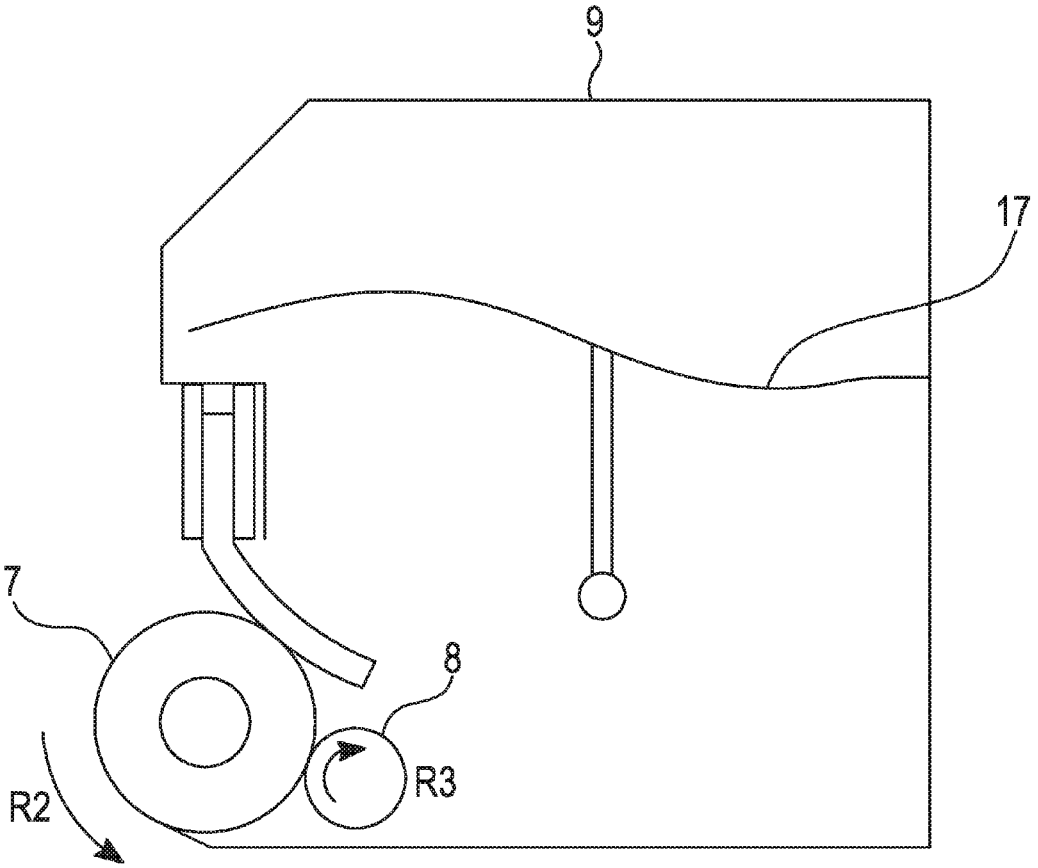
FIG. 2 is a schematic sectional view illustrating an example of a developing apparatus according to the present invention.

FIG. 2 is a schematic sectional view illustrating an example of the developing apparatus of the present invention. In addition, FIG. 3 is a schematic sectional view illustrating an example of an image-forming apparatus having built therein the developing apparatus of the present invention.

Figure 3:
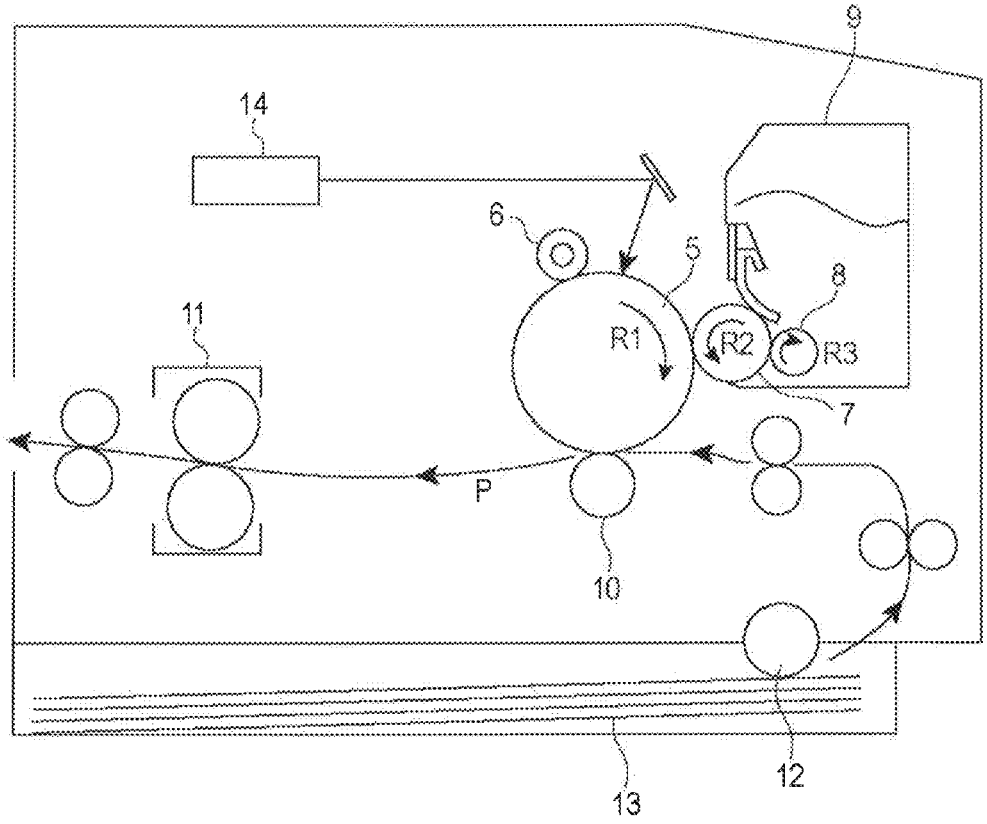
FIG. 3 is a schematic sectional view illustrating an example of an image-forming apparatus including the developing apparatus according to the present invention.

In FIG. 2 and/or FIG. 3, an electrostatic latent image bearing member 5 as an image carrier having formed thereon an electrostatic latent image is rotated in a direction indicated by an arrow R1. A toner carrier 7 rotates in a direction indicated by an arrow R2 to convey toner 17 to a development area where the toner carrier 7 and the electrostatic latent image bearing member 5 are opposite to each other. In addition, a toner-supplying member 8 is brought into contact with the toner carrier and rotates in a direction indicated by an arrow R3 to supply the toner 17 to the surface of the toner carrier.

Provided around the electrostatic latent image bearing member 5 are, for example, a charging roller 6, a transferring member (transfer roller) 10, a fixing device 11, and a pickup roller 12. The electrostatic latent image bearing member 5 is charged by the charging roller 6. Then, exposure (image exposure) is performed by irradiating the electrostatic latent image bearing member 5 with laser light (image exposure light) from a laser generator (image exposure unit) 14, whereby an electrostatic latent image corresponding to a target image is formed. The electrostatic latent image on the electrostatic latent image bearing member 5 is developed with toner in a developing device 9 to provide a toner image. The toner image is transferred onto a transfer material (paper) 13 by the transferring member (transfer roller) 10 brought into abutment with the electrostatic latent image bearing member 5 through the transfer material. The transfer of the toner image onto the transfer material may be performed through an intermediate transfer member. The transfer material (paper) 13 onto which the toner image has been mounted is conveyed to the fixing device 11 where the image is fixed onto the transfer material (paper) 13.

Preferably used in a charging step in the developing apparatus of the present invention is such a contact charging apparatus that the electrostatic latent image bearing member and the charging roller are brought into contact with each other while forming an abutting portion, and a predetermined charging bias is applied to the charging roller to charge the surface of the electrostatic latent image bearing member to a predetermined potential having predetermined polarity. When contact charging is performed as described above, stable and uniform charging can be performed, and the generation of ozone can be reduced. In addition, a charging roller that rotates in the same direction as that of the electrostatic latent image bearing member is more preferably used in order that its contact with the electrostatic latent image bearing member may be kept uniform and uniform charging may be performed.

Preferred process conditions at the time of the use of the charging roller can be, for example, as follows: a direct-current voltage or a voltage obtained by superimposing an alternating voltage on the direct-current voltage is applied at an abutting pressure of the charging roller of 4.9 N/m or more and 490.0 N/m or less.

It is preferred that the alternating voltage have a peak-to-peak voltage of 0.5 kVpp or more and 5.0 kVpp or less, and an alternating frequency of 50 Hz or more and 5 kHz or less, and the direct-current voltage have a voltage absolute value of 400 V or more and 1,700 V or less.

As an elastic material as a material for the charging roller, there are given, for example: a rubber material obtained by dispersing a conductive substance for resistance adjustment such as carbon black or a metal oxide in ethylene-propylene-diene polyethylene (EPDM), urethane, a butadiene-acrylonitrile rubber (NBR), a silicone rubber, or an isoprene rubber; and a foamed product thereof. However, the material is not limited thereto. In addition, the resistance adjustment can be performed by using an ion conductive material without dispersing the conductive substance or in combination with the conductive substance.

In addition, a mandrel to be used in the charging roller is, for example, aluminum or SUS. The charging roller is placed while being brought into press contact with a member to be charged as the electrostatic latent image bearing member with a predetermined pressing force against elasticity. Thus, a charging abutting portion as an abutting portion between the charging roller and the electrostatic latent image bearing member is formed.

Next, a contact transferring step to be preferably applied in the developing apparatus of the present invention is specifically described. In the contact transferring step, a toner image is electrostatically transferred onto a recording medium while the electrostatic latent image bearing member abuts with the transferring member having applied thereto a voltage opposite in polarity to the toner through the recording medium. The abutting pressure of the transferring member is preferably 2.9 N/m or more, more preferably 19.6 N/m or more in terms of a linear pressure. When the linear pressure as the abutting pressure is less than 2.9 N/m, the conveyance shift of the recording medium or a transfer failure is liable to occur.

In the present invention, a toner-regulating member preferably abuts with the toner carrier through the toner to regulate the thickness of a toner layer on the toner carrier. With such construction, a fog-free and high-quality image can be obtained. The toner-regulating member that abuts with the toner carrier is generally a regulating blade and the blade can be suitably used in the present invention as well.

A rubber elastic body such as a silicone rubber, a urethane rubber, or a NBR, a synthetic resin elastic body such as polyethylene terephthalate, or a metal elastic body such as a phosphor bronze plate or a SUS plate can be used as the regulating blade, and a composite of two or more kinds thereof is also permitted. Further, a product obtained as follows may be used: a charging control substance such as a resin, a rubber, a metal oxide, or a metal is attached for the purpose of controlling the chargeability of the toner to an elastic support such as the rubber, synthetic resin, or metal elastic body so as to be brought into contact with a portion of the support abutting with the toner carrier. Of those, a product obtained as follows is particularly preferred: a resin or a rubber is attached to the metal elastic body so as to be brought into contact with a portion of the elastic body abutting with the toner carrier.

A material for the member to be attached to the metal elastic body is preferably a material that is easily charged to positive polarity such as a urethane rubber, a urethane resin, a polyamide resin, or a nylon resin.

A base portion as an upper side portion side of the regulating blade is fixed and held on a developing device side, and a lower side portion side thereof is brought into abutment with the surface of the toner carrier with a moderate elastic pressing force while being brought into a curved state in the forward direction or reverse direction of the toner carrier against the elastic force of the blade.

It is effective that an abutting pressure between the regulating blade and the toner carrier is preferably 1.30 N/m or more and 245.0 N/m or less, more preferably 4.9 N/m or more and 118.0 N/m or less in terms of a linear pressure in the bus direction of the toner carrier. When the abutting pressure is less than 1.30 N/m, it becomes difficult to uniformly apply the toner, which is liable to be responsible for fog or scattering. When the abutting pressure is more than 245.0 N/m, a large pressure is applied to the toner and hence the deterioration of the toner tends to be liable to occur.

The amount of the toner layer on the toner carrier is preferably 2.0 g/m$^2$ or more and 15.0 g/m$^2$ or less, more preferably 3.0 g/m$^2$ or more and 14.0 g/m$^2$ or less.

When the amount of the toner on the toner carrier is less than 2.0 g/m$^2$, a sufficient image density is hardly obtained.

On the other hand, when the amount of the toner on the toner carrier is more than 15.0 g/m$^2$, a regulation failure is liable to occur. In addition, the uniform chargeability of the toner is liable to be impaired, which tends to cause an increase in fog.

It should be noted that in the present invention, the amount of the toner on the toner carrier can be arbitrarily changed by changing the surface roughness (Ra) of the toner carrier, the free length of the regulating blade, and the abutting pressure of the regulating blade.

The amount of the toner on the toner carrier is measured as described below. A thimble is mounted on a suction opening having an outer diameter of 6.5 mm. The resultant is attached to a cleaner, and the toner on the toner carrier is sucked while the thimble is aspirated. A value obtained by dividing the amount (g) of the sucked toner by the sucked area (m$^2$) is regarded as the amount of the toner on the toner carrier.

In the present invention, the outer diameter of the toner carrier carrying the toner is preferably 8.0 mm or more and 14.0 mm or less. The outer diameter of the toner carrier is desirably as small as possible in a sense that the developing apparatus can be reduced in size. However, as the outer diameter reduces, the developability of the developing apparatus is liable to reduce and the fog tends to worsen. Accordingly, in the toner carrier and toner to be used in the present invention, the outer diameter of the toner carrier is preferably 8.0 mm or more and 14.0 mm or less in order that compatibility between the reduction in size and the suppression of the fog may be achieved.

The surface roughness of the toner carrier to be used in the present invention falls within the range of preferably from 0.3 μm or more to 5.0 μm or less, more preferably from 0.5 μm or more to 4.5 μm or less in terms of a center line average roughness Ra in the standard of JIS B 0601:1994 "Surface Roughness".

When the Ra is 0.3 μm or more and 5.0 μm or less, the conveyance amount of the toner is sufficiently obtained, and the amount of the toner on the toner carrier can be easily regulated and hence a regulation failure hardly occurs. In addition, the charge quantity of the toner easily becomes uniform.

The center line average roughness Ra of the surface of the toner carrier in the standard of JIS B 0601:1994 "Surface Roughness" is measured with a SURFCORDER SE-3500 manufactured by Kosaka Laboratory Ltd. Nine points (three points in a circumferential direction for each of three points taken at an equal interval in an axial direction) were subjected to the measurement under the measurement conditions of a cutoff of 0.8 mm, an evaluation length of 4 mm, and a feeding speed of 0.5 mm/s, and the average of the nine measured values was calculated.

The surface roughness of the toner carrier in the present invention can be caused to fall within the range by, for example, changing the polished state of the surface layer of the toner carrier, or adding spherical carbon particles, carbon fine particles, graphite, resin fine particles, or the like.

In the present invention, a developing step is preferably a step of applying a developing bias to the toner carrier to cause the toner to transfer to an electrostatic latent image on the electrostatic latent image bearing member to form a toner image, and the developing bias to be applied may be a direct-current voltage or may be a voltage obtained by superimposing an alternating electric field on the direct-current voltage.

A sinusoidal wave, a rectangular wave, a triangular wave, or the like can be appropriately used as the waveform of the alternating electric field. A pulse wave formed by periodically turning a direct-current power supply on and off is also permitted. As described above, a bias whose voltage value periodically changes can be used as the waveform of the alternating electric field.

Figure 4:
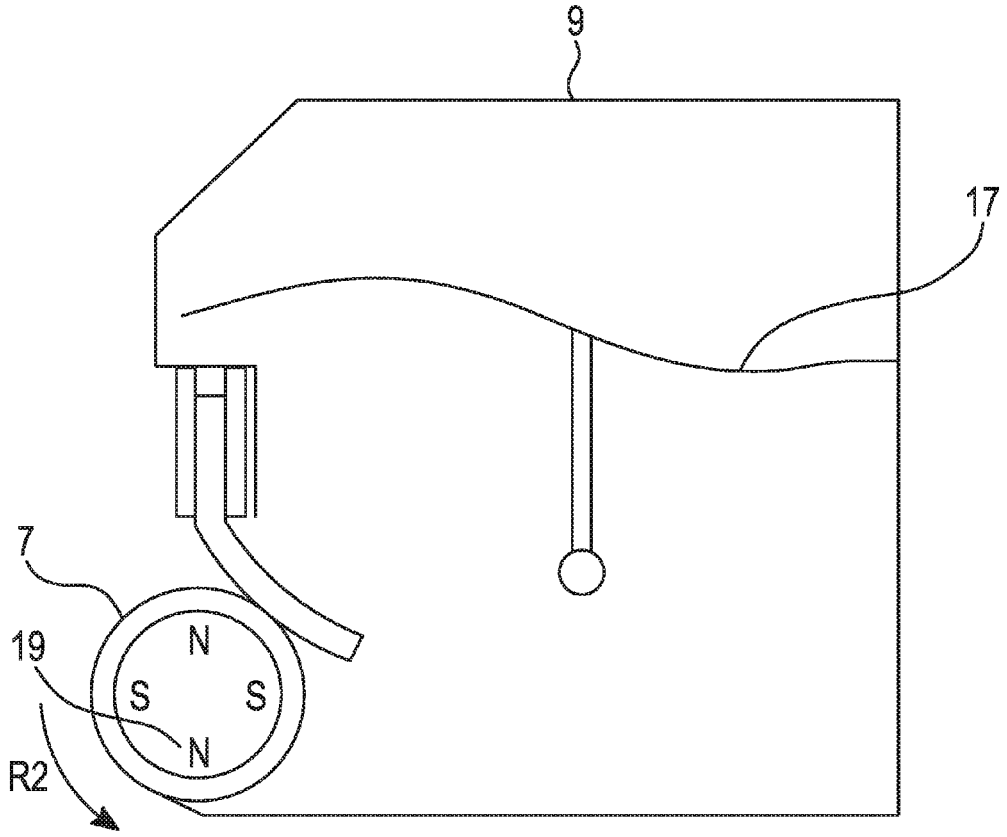
FIG. 4 is a schematic sectional view illustrating an example of the developing apparatus according to the present invention.

In the case where such a system that the toner is conveyed by magnetism without the use of any toner-supplying member is used in the present invention, a magnet needs to be placed in the toner carrier (reference numeral 19 of FIG. 4). In this case, the toner carrier preferably has a fixed magnet having many magnetic poles in itself, and the magnet preferably has 3 or more and 10 or less magnetic poles.

In the present invention, the absolute value (|V1−V2|) of a difference between the potential (V1) of the surface of the electrostatic latent image bearing member when the charging unit charges the surface of the electrostatic latent image bearing member and a direct-current voltage (V2) to be applied to the toner carrier when the electrostatic latent image is developed is preferably 200 V or more and 600 V or less.

There is a correlation between the |V1−V2| and recoverability, and as the |V1−V2| increases, the recoverability of residual toner improves. Accordingly, the |V1−V2| is preferably 200 V or more. On the other hand, when the |V1−V2| is more than 600 V, fog particularly in a high-temperature and high-humidity environment tends to worsen. Accordingly, in the present invention, the |V1−V2| is preferably 200 V or more and 600 V or less.

With regard to a value [V] for the |V1−V2| in the present invention, a value [V] in a low-temperature and low-humidity environment (15° C., 10% RH) is preferably higher than a value [V] in the high-temperature and high-humidity environment (32.5° C., 80% RH) by 100 V or more. As described in the foregoing, the recoverability of the residual toner in the low-temperature and low-humidity environment improves as the |V1−V2| increases. On the other hand, in the high-temperature and high-humidity environment, the fog tends to worsen as the |V1−V2| increases. Accordingly, the value [V] for the |V1−V2| in the low-temperature and low-humidity environment is extremely preferably set to be higher than the value [V] for the |V1−V2| in the high-temperature and high-humidity environment by 100 V or more because a high level of compatibility between the recoverability and the suppression of the fog can be achieved.

Next, methods of measuring various physical properties regarding the toner to be used in the present invention are described.

<Average Particle Diameter and Particle Size Distribution of Magnetic Toner>

The weight average particle diameter (D4) of the toner is calculated in the following manner. As a measuring apparatus, a precision particle size distribution measuring apparatus based on a pore electrical resistance method provided with a 100 μm aperture tube "Coulter Counter Multisizer 3" (trademark, manufactured by Beckman Coulter, Inc.) is used. For setting measurement conditions and analyzing measurement data, dedicated software included with the apparatus "Beckman Coulter Multisizer 3 Version 3.51" (manufactured by Beckman Coulter, Inc) is used. It should be noted that the measurement is performed with the number of effective measurement channels set to 25,000.

An electrolyte aqueous solution prepared by dissolving reagent grade sodium chloride in ion-exchanged water to have a concentration of 1 mass %, for example, "ISOTON II" (manufactured by Beckman Coulter, Inc) can be used in the measurement.

It should be noted that the dedicated software was set as described below prior to the measurement and the analysis.

In the "change standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc) is set as a Kd value. A threshold and a noise level are automatically set by pressing a "threshold/noise level measurement button." In addition, a current is set to 1,600 μA, a gain is set to 2, an electrolyte solution is set to ISOTON II, and a check mark is placed in a check box as to whether "the aperture tube is flushed after the measurement."

In the "setting for conversion from pulse to particle diameter" screen of the dedicated software, a bin interval is set to a logarithmic particle diameter, the number of particle diameter bins is set to 256, and a particle diameter range is set to the range of from 2 μm to 60 μm.

A specific measurement method is as described below.

(1) 200 mL of the electrolyte aqueous solution are charged into a 250-mL round-bottom beaker made of glass dedicated for the Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "aperture flush" function of the dedicated software.

(2) 30 mL of the electrolyte aqueous solution are charged into a 100-mL flat-bottom beaker made of glass. 0.3 mL of a diluted solution prepared by diluting "Contaminon N" (a 10 mass % aqueous solution of a neutral detergent for washing a precision measuring device formed of a nonionic surfactant, an anionic surfactant, and an organic builder and having a pH 7, manufactured by Wako Pure Chemical Industries, Ltd.) with ion-exchanged water by three mass fold is added as a dispersant to the electrolyte aqueous solution.

(3) An ultrasonic dispersing unit "Ultrasonic Dispension System Tetora 150" (manufactured by Nikkaki Bios Co., Ltd.) in which two oscillators each having an oscillatory frequency of 50 kHz are built so as to be out of phase by 180° and which has an electrical output of 120 W is prepared. 3.3 L of ion-exchanged water are charged into the water tank of the ultrasonic dispersing unit. 2 mL of the Contaminon N are charged into the water tank.

(4) The beaker in the item (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate with an ultrasonic wave from the ultrasonic dispersing unit to the fullest extent possible.

(5) 10 mg of toner are gradually added to and dispersed in the electrolyte aqueous solution in the beaker in the item (4) in a state in which the electrolyte aqueous solution is irradiated with the ultrasonic wave. Then, the ultrasonic dispersion treatment is continued for an additional 60 seconds. It should be noted that the temperature of water in the water tank is appropriately adjusted so as to be 10° C. or more and 40° C. or less upon ultrasonic dispersion.

(6) The electrolyte aqueous solution in the item (5) in which the toner has been dispersed is dropped with a pipette to the round-bottom beaker in the item (1) placed in the sample stand, and the concentration of the toner to be measured is adjusted to 5%. Then, measurement is performed until the particle diameters of 50,000 particles are measured.

(7) The measurement data is analyzed with the dedicated software included with the apparatus, and the weight average particle diameter (D4) and the number average particle diameter (D1) are calculated.

<Measurement of Porosity of Toner>

$$\text{Porosity}=((\text{true density}-\text{tap density})/\text{true density})\times 100$$

Methods of measuring a true density and a tap density are described below.

(Measurement of True Density)

The true density of the toner is measured with a dry automatic densimeter "Accupyc 1330" manufactured by Shimadzu Corporation after precisely weighing 5.0 g of the toner.

(Measurement of Tap Density)

Measurement is performed with a powder tester manufactured by Hosokawa Micron Corporation and a container included with the powder tester in accordance with the procedure of the instruction manual of the powder tester. That is, the toner is loaded into the measuring cup (internal volume: V $cm^3$) of the powder tester and tapped. After the completion of the tapping, excess toner is sliced off with a blade, the weight (W g) of the toner in the container is measured, and its tap density can be obtained from the following expression. It should be noted that the number of times of the tapping is set to 600.

$$\text{Tap Density}=W/V(\text{g/Cm}^3)$$

Hereinafter, the present invention is described more specifically by way of production examples and examples, but the examples by no means limit the present invention. It should be noted that the term "part(s)" in each of all the following formulations means "part(s) by mass".

(Preparation of Substrate 2)

Prepared as the substrate 2 was a product obtained by applying and baking a primer (trade name: DY35-051; manufactured by Dow Corning Toray Co., Ltd.) onto a mandrel made of SUS304 and having a diameter of 6 mm.

(Production of Elastic Roller)

The substrate 2 prepared in the foregoing was placed in a metal mold and an addition-type silicone rubber composition obtained by mixing the following materials was poured into a cavity formed in the metal mold.

Liquid silicone rubber material (trade name: SE 6724 A/B; manufactured by Dow Corning Toray Co., Ltd.): 100 parts by mass Carbon black (trade name: TOKABLACK #4300; manufactured by Tokai Carbon Co., Ltd.): 15 parts by mass Silica powder as heat resistance-imparting agent: 0.2 part by mass Platinum catalyst: 0.1 part by mass An addition-type silicone rubber composition obtained by mixing materials shown in Table 1 below was poured into the cavity formed in the metal mold. Subsequently, the metal mold was heated to vulcanize and cure the silicone rubber at a temperature of 150° C. for 15 minutes. The substrate having formed on its peripheral surface a cured silicone rubber layer was removed from the metal mold, and then the curing reaction of the silicone rubber layer was completed by further heating the substrate at a temperature of 180° C. for 1 hour. Thus, an elastic roller D-1 in which a silicone rubber elastic layer having a diameter of 12 mm was formed on the outer periphery of the substrate 2 was produced.

(Preparation of Surface Layer 4)

A synthesis example for obtaining a polyurethane surface layer of the present invention is described below.

(Synthesis of Isocyanate Group-Terminated Prepolymer A-1)

Under a nitrogen atmosphere, 100.0 g of a polypropylene glycol-based polyol (trade name: EXCENOL 4030; manufactured by ASAHI GLASS CO., LTD.) were gradually dropped to 17.7 parts by mass of tolylene diisocyanate (TDI) (trade name: COSMONATE T80; manufactured by Mitsui Chemicals, Inc.) in a reaction vessel while a temperature in the reaction vessel was held at 65° C. After the completion of the dropping, the mixture was subjected to a reaction at a temperature of 65° C. for 2 hours. The resultant reaction mixture was cooled to room temperature to provide an isocyanate group-terminated prepolymer A-1 having an isocyanate group content of 3.8 wt %.

(Synthesis of Isocyanate Group-Terminated Prepolymer A-2)

Under a nitrogen atmosphere, 100.0 g of a butylene adipate-based polyol (trade name: NIPPOLAN 4010; manufactured by Nippon Polyurethane Industry Co., Ltd.) were gradually dropped to 33.8 parts by mass of polymeric MDI (trade name: MILLIONATE MR; manufactured by Nippon Polyurethane Industry Co., Ltd.) in a reaction vessel while a temperature in the reaction vessel was held at 65° C. After the completion of the dropping, the mixture was subjected to a reaction at a temperature of 65° C. for 2 hours. The resultant reaction mixture was cooled to room temperature to provide an isocyanate group-terminated prepolymer A-2 having an isocyanate group content of 4.3 wt %.

(Synthesis of Amino Compound (Compound Represented by Structural Formula (1)))

(Synthesis of Amino Compound B-1)

In a reaction vessel mounted with a stirring apparatus, a temperature gauge, a reflux tube, a dropping apparatus, and a temperature-adjusting apparatus, 100.0 parts by mass (1.67 mol) of ethylenediamine and 100 parts by mass of pure water were warmed to 40° C. while being stirred. Next, 425.3 parts by mass (7.35 mol) of propylene oxide were gradually dropped over 30 minutes while a reaction temperature was held at 40° C. or less. A reaction was performed by further stirring the mixture for 1 hour. Thus, a reaction mixture was obtained. Water was distilled off by heating the resultant reaction mixture under reduced pressure. Thus, 426 g of an amino compound B-1 were obtained.

(Synthesis of Amino Compound B-2)

An amino compound B-2 was obtained in the same manner as in the synthesis example of the amino compound B-1 except that the blending amount of propylene oxide and the reaction time were changed as shown in Table 1 below.

TABLE 1

| | Kind of amino compound serving as raw material | | Added raw material | | |
|---|---|---|---|---|---|
| No. | Compound | Part(s) by mass | Compound | Part(s) by mass | Reaction time |
| B-1 | Ethylene-diamine | 100.0 | Propylene oxide | 425.3 | 1 h |
| B-2 | | | | 1276.0 | 2 h |
| B-3 | Diethylene-triamine | | Ethylene oxide | 235.0 | 1 h |
| B-4 | | | 2-Methyl-tetrahydro-furan | 1377.7 | 2 h |
| B-5 | Tetraethylene-pentamine | | 8-Bromo-1-octanol | 851.5 | 1.5 h |
| B-6 | Butylene-diamine | | Ethyleneimine | 215.0 | 1 h |
| B-7 | | | 8-Bromo-1-aminooctane | 1040.0 | |

(Synthesis of Amino Compound B-3)

In a reaction vessel mounted with a stirring apparatus, a temperature gauge, a dropping apparatus, and a temperature-adjusting apparatus, 100.0 parts by mass (0.97 mol) of diethylenetriamine and 100 parts by mass of ethanol were warmed to 40° C. while being stirred. Next, 235.0 parts by mass (5.34 mol) of ethylene oxide were gradually dropped over 30 minutes while a reaction temperature was held at 60° C. or less. A reaction was performed by further stirring the mixture for 1 hour. Thus, a reaction mixture was obtained. Ethanol was distilled off by heating the resultant reaction mixture under reduced pressure. Thus, 276 g of an amino compound B-3 were obtained.

(Synthesis of Amino Compound B-4)

An amino compound B-4 was obtained in the same manner as in the synthesis example of the amino compound B-3 except that ethylene oxide was changed to 2-methyltetrahydrofuran and its blending amount and the reaction time were changed as shown in Table 1.

(Synthesis of Amino Compound B-5)

In a reaction vessel mounted with a stirring apparatus, a temperature gauge, a reflux tube, a dropping apparatus, and a temperature-adjusting apparatus, 100.0 parts by mass (0.53 mol) of tetraethylenepentamine and 100 parts by mass of ethanol were warmed to 40° C. while being stirred. Next, 851.5 parts by mass (4.08 mol) of 8-bromo-1-octanol were gradually dropped over 30 minutes while a reaction temperature was held at 40° C. or less. A reaction was performed by further stirring the mixture for 1.5 hours. Thus, a reaction mixture was obtained. Ethanol was distilled off by heating the resultant reaction mixture under reduced pressure. Thus, 1,288 g of an amino compound B-5 were obtained.

(Synthesis of Amino Compound B-6)

In a reaction vessel mounted with a stirring apparatus, a temperature gauge, a reflux tube, a dropping apparatus, and a temperature-adjusting apparatus, 100.0 parts by mass (1.14 mol) of butylenediamine and 100 parts by mass of ethanol were warmed to 40° C. while being stirred. Next, 215.0 parts by mass (5.02 mol) of ethyleneimine were gradually dropped over 30 minutes while a reaction temperature was held at 40° C. or less. A reaction was performed by further stirring the mixture for 1 hour. Thus, a reaction mixture was obtained. Ethanol was distilled off by heating the resultant reaction mixture under reduced pressure. Thus, 216 g of an amino compound B-6 were obtained.

(Synthesis of Amino Compound B-7)

An amino compound B-7 was obtained in the same manner as in the synthesis example of the amino compound B-6 except that ethyleneimine was changed to 8-bromo-1-aminooctane and its blending amount was changed as shown in Table 1.

Table 2 shows the structures of the resultant amino compounds. In the table, n represents the number of repetitions of an amino structural unit represented by the structural formula (1) and m represents an ether repetition number in the case where $R^3$ represents the structural formula (2). In addition, the column "number of groups" in the table represents the number of terminal hydroxyl groups or terminal amino groups in one molecule of each amino compound.

TABLE 2

| Amino compound | | | | | | | |
|---|---|---|---|---|---|---|---|
| | $R^3$ | | $R^5$ | | | Terminal functional | Number of |
| No. | n | Structure | Structure | m | $R^4$ | group | groups |
| B-1 | 1 | —$CH_2CH(CH_3)$—OH | — | — | —$CH_2CH_2$— | OH | 4 |
| B-2 | | — | —$CH_2CH(CH_3)$—O— | 3 | | | 4 |
| B-3 | 2 | —$CH_2CH_2$—OH | — | — | | | 5 |
| B-4 | | — | —$CH_2CH_2CH(CH_3)CH_2$—O— | 3 | | | 5 |
| B-5 | 4 | —$(CH_2)_8$—OH | — | — | | | 7 |
| B-6 | 1 | —$CH_2CH_2$—$NH_2$ | — | — | —$(CH_2)_4$— | $NH_2$ | 4 |
| B-7 | | —$(CH_2)_8$—$NH_2$ | — | — | | | 4 |

Structural formula (1)

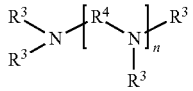

Structural formula (2)

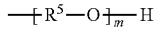

<Production of Toner Carrier 1>

617.9 Parts by mass of the isocyanate group-terminated prepolymer A-1, 34.2 parts by mass of the amino compound B-1, 117.4 parts by mass of carbon black (trade name: MA230; manufactured by Mitsubishi Chemical Corporation), and 130.4 parts by mass of urethane resin fine particles (trade name: ART PEARL C-400; manufactured by Negami Chemical Industrial Co., Ltd.) were stirred and mixed as materials for the surface layer 4.

Next, methyl ethyl ketone (hereinafter referred to as "MEK") was added to the mixture so that the total solid content ratio became 30 mass %. After that, the contents were mixed with a sand mill. Next, the viscosity of the mixture was further adjusted to from 10 to 13 cps with MEK. Thus, a paint for forming a surface layer was prepared.

A coating film of the paint for forming a surface layer was formed on the surface of the elastic layer of the elastic roller D-1 produced in advance by immersing the elastic roller D-1 in the paint, and was dried. The dried product was further subjected to a heat treatment at a temperature of 150° C. for 1 hour to provide a surface layer having a thickness of 15 μm on the outer periphery of the elastic layer. Thus, a toner carrier 1 was produced.

<Production of Toner Carriers 2 to 7>

Paints for forming surface layers were each prepared in the same manner as in the production of the toner carrier 1 except that materials shown in Table 3 below were used as materials for the surface layer 4. Then, toner carriers 2 to 7 were each produced by applying each paint to the elastic roller D-1, and drying and heating the paint in the same manner as in the production of the toner carrier 1.

TABLE 3

| Toner carrier | Isocyanate group-terminated prepolymer No. | Part(s) by mass | Compound represented by structural formula (1) No. | Part(s) by mass |
|---|---|---|---|---|
| 1 | A-1 | 617.9 | B-1 | 34.2 |
| 2 | | 545.0 | B-2 | 107.2 |
| 3 | | 618.9 | B-3 | 33.2 |
| 4 | A-2 | 527.7 | B-4 | 124.4 |
| 5 | | 575.6 | B-5 | 76.5 |
| 6 | | 623.7 | B-6 | 28.4 |
| 7 | | 584.0 | B-7 | 68.2 |

<Production of Toner Carrier 8>

632.8 Parts by mass of the isocyanate group-terminated prepolymer A-2, 19.5 parts by mass of pentaerythritol, 117.4 parts by mass of carbon black (trade name: MA230; manufactured by Mitsubishi Chemical Corporation), and 130.5 parts by mass of urethane resin fine particles (trade name: ART PEARL C-400; manufactured by Negami Chemical Industrial Co., Ltd.) were stirred and mixed as materials for the surface layer 4.

A paint for forming a surface layer according to a toner carrier 8 was prepared by performing the subsequent procedure in the same manner as in the method of preparing the paint for forming a surface layer according to the production of the toner carrier 1. The toner carrier 8 was produced by applying the paint for forming a surface layer to the surface of the silicone rubber elastic layer of the elastic roller D-1 and drying the paint to form a surface layer in the same manner as in the production of the toner carrier 1.

<Production of Toner Carrier 9>

351.6 Parts by mass of the isocyanate group-terminated prepolymer A-2, 300.5 parts by mass of a polypropylene glycol-based polyol (trade name: EXCENOL 230; manufactured by ASAHI GLASS CO., LTD.), 117.4 parts by mass of carbon black (trade name: MA230; manufactured by Mitsubishi Chemical Corporation), and 130.5 parts by mass of urethane resin fine particles (trade name: ART PEARL C-400; manufactured by Negami Chemical Industrial Co., Ltd.) were stirred and mixed as materials for the surface layer 4.

A paint for forming a surface layer according to a toner carrier 9 was prepared by performing the subsequent procedure in the same manner as in the method of preparing the paint for forming a surface layer according to the production of the toner carrier 1. The toner carrier 9 was produced by applying the paint for forming a surface layer to the surface of the silicone rubber elastic layer of the elastic roller D-1 and drying the paint to form a surface layer in the same manner as in the production of the toner carrier 1.

<Production of Magnetic Material 1>

An aqueous solution containing ferrous hydroxide was prepared by mixing, into an aqueous solution of ferrous sulfate, a caustic soda solution in an amount of 1.1 equivalents with respect to an iron atom, $P_2O_5$ in an amount corresponding to 0.15 mass % in terms of a phosphorus atom with respect to the iron atom, and $SiO_2$ in an amount corresponding to 0.50 mass % in terms of a silicon atom with respect to the iron atom. The pH value of the aqueous solution was set to pH 7.5 and an oxidation reaction was performed at 85° C. while air was blown into the solution. Thus, a slurry liquid containing a seed crystal was prepared.

Next, an aqueous solution of ferrous sulfate was added to the slurry liquid so that its amount became 1.1 equivalents with respect to the original alkali amount (sodium component of caustic soda). After that, the pH value of the slurry liquid was maintained at pH 7.4 and an oxidation reaction was advanced while air was blown into the liquid. Thus, a slurry liquid containing magnetic iron oxide was obtained. The slurry was filtered, washed, dried, and subjected to shredding treatment to provide a magnetic material 1 having a volume average particle diameter (D3) of 0.22 μm.

<Production of Toner 1>

Styrene/n-butyl acrylate copolymer (mass ratio: 76/24): 100.0 parts by mass

Magnetic material 1: 100.0 parts by mass

Polyethylene wax (melting point: 110° C.): 3.0 parts by mass

Iron complex of monoazo dye (T-77 manufactured by Hodogaya Chemical Co., Ltd.): 2.0 parts by mass The materials were mixed with a blender, and the mixture was melted and kneaded with a biaxial extruder heated to 120° C. The kneaded product was cooled and then coarsely pulverized with a hammer mill. The coarsely pulverized product was finely pulverized with a jet mill and then the finely pulverized product was subjected to air classification to provide toner particles 1.

100 Parts by mass of the toner particles 1, 0.1 part by mass of polymethyl acrylate fine particles having a number average particle diameter (D1) of 100 nm, and 1.2 parts by mass of silica fine particles having a number average particle diameter (D1) of 12 nm were loaded into a Henschel Mixer FM10C (manufactured by NIPPON COKE & ENGINEERING CO., LTD.). Then, the contents were mixed at 4,000 rpm for 4 minutes to provide a toner 1. The resultant toner 1 had a weight average particle diameter (D4) of 11.2 μm, a ratio D4/D1 of its weight average particle diameter (D4) to its number average particle diameter (D1) of 1.22, and a porosity of 53. Table 4 shows the physical properties of the toner 1.

<Production of Toners 2 to 17>

Toners 2 to 17 were each obtained in the same manner as in the production of the toner 1 except that the toner particles to be used and the fine particles to be added were changed as shown in Table 4. Table 4 shows the physical properties of the toners 2 to 17.

It should be noted that toner particles 2 to 5 and 7 to 10 were each obtained in the same manner as in the production of the toner particles 1 except that a condition for fine pulverization after the materials had been melted, kneaded, and cooled, and a condition for air classification were changed.

Toner particles 6 were obtained by subjecting the toner particles 5 to the following treatment twice: the toner particles 5 were treated with a hybridizer (manufactured by NARA MACHINERY CO., LTD.) at 6,000 rpm for 3 minutes.

Toner particles 11 were obtained by performing the surface modification of the toner particles 5 with a METEORAINBOW (manufactured by Nippon Pneumatic Mfg. Co., Ltd.) as an apparatus configured to blow hot air onto the toner particles to modify the surfaces of the toner particles. The surface modification was performed under the conditions of a raw material-supplying speed of 2 kg/hr, a hot air flow rate of 700 L/min, and a discharged hot air temperature of 300° C.

TABLE 4

| Toner No. | Toner particles | Added fine particles: Kind | Number average particle diameter (D1) | Addition amount |
|---|---|---|---|---|
| Toner 1 | Toner particles 1 | Silica fine particles | 12 nm | 1.2 parts by mass |
| | | Polymethyl acrylate fine particles | 100 nm | 0.1 parts by mass |
| Toner 2 | Toner particles 2 | Silica fine particles | 12 nm | 1.2 parts by mass |
| | | Polymethyl methacrylate fine particles | 150 nm | 0.5 parts by mass |
| Toner 3 | Toner particles 2 | Silica fine particles | 12 nm | 1.2 parts by mass |
| | | Polymethyl methacrylate fine particles | 150 nm | 1.0 parts by mass |
| Toner 4 | Toner particles 2 | Silica fine particles | 12 nm | 1.2 parts by mass |
| | | Strontium titanate | 2.0 μm | 3.0 parts by mass |
| Toner 5 | Toner particles 2 | Silica fine particles | 12 nm | 1.2 parts by mass |
| | | Barium titanate | 1.8 μm | 3.0 parts by mass |
| Toner 6 | Toner particles 2 | Silica fine particles | 12 nm | 1.2 parts by mass |
| | | Strontium titanate | 80 nm | 0.5 parts by mass |
| Toner 7 | Toner particles 2 | Silica fine particles | 12 nm | 1.2 parts by mass |
| | | Polyurethane fine particles | 4.8 μm | 1.0 parts by mass |
| Toner 8 | Toner particles 2 | Silica fine particles | 12 nm | 1.2 parts by mass |
| | | — | — | — |
| Toner 10 | Toner particles 4 | Silica fine particles | 12 nm | 1.2 parts by mass |
| | | — | — | — |
| Toner 11 | Toner particles 5 | Silica fine particles | 12 nm | 1.2 parts by mass |
| | | — | — | — |
| Toner 12 | Toner particles 6 | Silica fine particles | 12 nm | 1.2 parts by mass |
| | | — | — | — |
| Toner 13 | Toner particles 7 | Silica fine particles | 12 nm | 1.2 parts by mass |
| | | — | — | — |
| Toner 14 | Toner particles 8 | Silica fine particles | 12 nm | 1.2 parts by mass |
| | | — | — | — |
| Toner 15 | Toner particles 9 | Silica fine particles | 12 nm | 1.2 parts by mass |
| | | — | — | — |
| Toner 16 | Toner particles 10 | Silica fine particles | 12 nm | 1.2 parts by mass |
| | | — | — | — |
| Toner 17 | Toner particles 11 | Silica fine particles | 12 nm | 1.2 parts by mass |
| | | — | — | — |

| Toner No. | Toner particles | Toner physical properties: Weight average particle diameter of toner | D4/D1 | Porosity |
|---|---|---|---|---|
| Toner 1 | Toner particles 1 | 11.2 μm | 1.22 | 53 |
| Toner 2 | Toner particles 2 | 11.5 μm | 1.25 | 53 |
| Toner 3 | Toner particles 2 | 11.5 μm | 1.25 | 54 |
| Toner 4 | Toner particles 2 | 11.5 μm | 1.25 | 54 |
| Toner 5 | Toner particles 2 | 11.5 μm | 1.25 | 54 |
| Toner 6 | Toner particles 2 | 11.5 μm | 1.25 | 53 |
| Toner 7 | Toner particles 2 | 11.5 μm | 1.25 | 54 |
| Toner 8 | Toner particles 2 | 11.5 μm | 1.25 | 53 |
| Toner 9 | Toner particles 3 | 10.6 μm | 1.30 | 54 |
| Toner 10 | Toner particles 4 | 10.2 μm | 1.34 | 55 |
| Toner 11 | Toner particles 5 | 9.5 μm | 1.36 | 53 |
| Toner 12 | Toner particles 6 | 9.5 μm | 1.35 | 50 |
| Toner 13 | Toner particles 7 | 14.0 μm | 1.35 | 56 |
| Toner 14 | Toner particles 8 | 6.8 μm | 1.31 | 50 |
| Toner 15 | Toner particles 9 | 8.2 μm | 1.33 | 52 |
| Toner 16 | Toner particles 10 | 10.9 μm | 1.45 | 58 |
| Toner 17 | Toner particles 11 | 9.5 μm | 1.35 | 46 |

Example 1

Image-Forming Apparatus

A printer LBP7700C manufactured by Canon Inc. was reconstructed and used in an image output evaluation. The printer was reconstructed as follows: the toner-supplying member of a developing apparatus was reconstructed so as to rotate in a direction opposite to that of a toner carrier as illustrated in FIG. 2 and the application of a voltage to the toner-supplying member was stopped. In addition, a cleaning blade was removed, and an abutting pressure was adjusted so that the width of an abutting portion between the toner carrier and an electrostatic latent image bearing member became 1.1 mm.

100 Grams of the toner 1 were loaded into the developing apparatus reconstructed as described above, and a developing apparatus was produced by using the resultant and the toner carrier 2. The produced developing apparatus was set in a black station.

Next, in a high-temperature and high-humidity environment (32.5° C., 80% RH), a direct-current voltage was applied to a charging member so that a potential on the electrostatic latent image bearing member became −600 V. In addition, an image output test was performed while a direct-current voltage of −300 V was applied to the toner carrier so that the |V1−V2| became 300 V.

In a low-temperature and low-humidity environment (15° C., 10% RH), a direct-current voltage was applied to the charging member so that the potential on the electrostatic latent image bearing member became −900 V. In addition, the image output test was performed while a direct-current voltage of −300 V was applied to the toner carrier so that the |V1−V2| became 600 V.

It should be noted that the image output test was performed by using a horizontal line having a print percentage of 2% as an image on 3,000 sheets of paper that were continuously fed.

As a result, even in the case of a cleaner-less system, in the high-temperature and high-humidity environment, a fog-free and clear image was obtained, and in the low-temperature and low-humidity environment, recoverability was good and a good image free of a cleaner-less ghost resulting from a recovery failure was able to be obtained. Table 5 shows the evaluation results.

Methods for the respective evaluations performed in Examples and Comparative Examples of the present invention, and judgment criteria therefor are described below.

<Image Density>

With regard to an image density, a solid image portion was formed and the density of the solid image was measured with a Macbeth reflection densitometer (manufactured by GretagMacbeth).

<Fog>

A white image was output and its reflectance was measured with a REFLECTOMETER MODEL TC-6DS manufactured by Tokyo Denshoku CO., LTD. Meanwhile, the reflectance of transfer paper (plain paper) before the formation of the white image was similarly measured. A green filter was used as a filter. Fog was calculated from the reflectances before and after the output of the white image by using the following expression.

Fog (reflectance) (%)=reflectance (%) of plain paper−reflectance (%) of white image sample It should be noted that judgment criteria for the fog are as described below.

A: An extremely good level (the fog is less than 1.5%.)

B: A good level (the fog is 1.5% or more and less than 2.5%.)

C: A level at which no problems arise in practical use (the fog is 2.5% or more and less than 3.5%.)

D: A level not preferred in practical use (the fog is 3.5% or more.)

<Recoverability>

With regard to recoverability, a solid black image corresponding to one round of the electrostatic latent image bearing member was formed, the image was passed through a transferring step and a charging step, residual toner before its passage through a development area was taped, and the density of the tape was measured with the Macbeth reflection densitometer. A density before recovery was determined by subtracting the density of the tape alone from the density of the tape with the residual toner. Next, the image was passed through the transferring step, the charging step, and the development area, the top of the electrostatic latent image bearing member was taped in an area before a next transferring step, and the density of the tape was measured with the Macbeth reflection densitometer. A density after the recovery was determined by subtracting the density of the tape alone from the density on the electrostatic latent image bearing member thus measured.

The recoverability was calculated by using the density before the recovery and the density after the recovery as described below.

Recoverability=1−(density after recovery/density before recovery)

It should be noted that judgment criteria for the recoverability are as described below.

A: The recoverability is 0.95 or more, in other words, extremely good.

B: The recoverability is 0.90 or more and less than 0.95, in other words, good.

C: The recoverability is 0.85 or more and less than 0.90, in other words, at a level at which no problems arise in practical use.

Examples 2 to 22

Image output evaluations were each performed in the same manner as in Example 1 by producing a developing apparatus with such a combination of a toner and a toner carrier as shown in Table 5, and setting the |V1−V2| as shown in Table 5. As a result, in each of all the developing apparatus, the fog in the high-temperature and high-humidity environment was at or above a level at which no problems arose in practical use, and the recoverability in the low-temperature and low-humidity environment was good and an image free of a cleaner-less ghost resulting from a recovery failure was able to be obtained. Table 5 shows the evaluation results.

Reference Examples 1 to 4

Image output evaluations were each performed in the same manner as in Example 1 by producing a developing apparatus with such a combination of a toner and a toner carrier as shown in Table 5, and setting the |V1−V2| as shown in Table 5. As a result, in each of all the developing apparatus, the fog in the high-temperature and high-humidity environment, and the recoverability in the low-temperature and low-humidity environment were each at a level at which no problems arose in practical use. Table 5 shows the evaluation results.

Comparative Examples 1 and 2

Developing apparatus were each produced with such a combination of a toner and a toner carrier as shown in Table 5, and each developing apparatus was subjected to an image output evaluation in the same manner as in Example 1. As a result, in each developing apparatus, the result of the recoverability in the low-temperature and low-humidity environment was such that no problems arose in practical use, but the fog in the high-temperature and high-humidity environment was bad. Table 5 shows the evaluation results.

TABLE 5

| | | | | High-temperature and high-humidity environment | | | |
|---|---|---|---|---|---|---|---|
| | | | | Initial stage | | After image output on 3,000 sheets | |
| | Toner | Toner carrier | \|V1 − V2\| | Density | Fog | Density | Fog |
| Example 1 | Toner 1 | 2 | 300 | 1.48 | A | 1.45 | A |
| Example 2 | Toner 2 | 3 | 300 | 1.47 | A | 1.44 | A |
| Example 3 | Toner 3 | 3 | 300 | 1.48 | A | 1.44 | A |
| Example 4 | Toner 2 | 3 | 300 | 1.48 | A | 1.43 | A |
| Example 5 | Toner 2 | 3 | 200 | 1.47 | A | 1.44 | A |
| Example 6 | Toner 2 | 3 | 150 | 1.46 | A | 1.44 | A |
| Example 7 | Toner 4 | 3 | 150 | 1.47 | A | 1.45 | A |
| Example 8 | Toner 5 | 3 | 150 | 1.45 | A | 1.43 | A |
| Example 9 | Toner 6 | 3 | 150 | 1.43 | A | 1.41 | B |
| Example 10 | Toner 7 | 3 | 150 | 1.42 | A | 1.40 | B |
| Example 11 | Toner 8 | 3 | 150 | 1.43 | A | 1.41 | B |
| Example 12 | Toner 9 | 3 | 150 | 1.39 | A | 1.37 | B |
| Example 13 | Toner 10 | 3 | 150 | 1.36 | B | 1.33 | B |
| Example 14 | Toner 11 | 3 | 150 | 1.36 | B | 1.34 | B |
| Example 15 | Toner 12 | 3 | 150 | 1.35 | B | 1.33 | B |

TABLE 5-continued

| | | | | | | | |
|---|---|---|---|---|---|---|---|
| Example 16 | Toner 13 | 3 | 150 | 1.37 | B | 1.34 | B |
| Example 17 | Toner 10 | 2 | 150 | 1.36 | B | 1.35 | B |
| Example 18 | Toner 10 | 1 | 150 | 1.33 | B | 1.31 | C |
| Example 19 | Toner 10 | 4 | 150 | 1.34 | B | 1.31 | C |
| Example 20 | Toner 10 | 5 | 150 | 1.34 | B | 1.32 | C |
| Example 21 | Toner 10 | 6 | 150 | 1.33 | B | 1.30 | C |
| Example 22 | Toner 10 | 7 | 150 | 1.32 | B | 1.30 | C |
| Reference Example 1 | Toner 14 | 3 | 150 | 1.33 | C | 1.28 | C |
| Reference Example 2 | Toner 15 | 3 | 150 | 1.35 | C | 1.29 | C |
| Reference Example 3 | Toner 16 | 3 | 150 | 1.30 | C | 1.25 | C |
| Reference Example 4 | Toner 17 | 3 | 150 | 1.35 | B | 1.33 | C |
| Comparative Example 1 | Toner 10 | 8 | 150 | 1.31 | C | 1.22 | D |
| Comparative Example 2 | Toner 10 | 9 | 150 | 1.33 | C | 1.20 | D |

| | | | | Low-temperature and low-humidity environment | | | |
|---|---|---|---|---|---|---|---|
| | | Toner | | Initial stage | | After image output on 3,000 sheets | |
| | Toner | carrier | \|V1 − V2\| | Density | Recoverability | Density | Recoverability |
| Example 1 | Toner 1 | 2 | 600 | 1.45 | A | 1.43 | A |
| Example 2 | Toner 2 | 3 | 500 | 1.46 | A | 1.44 | A |
| Example 3 | Toner 3 | 3 | 400 | 1.46 | A | 1.43 | A |
| Example 4 | Toner 2 | 3 | 300 | 1.45 | A | 1.43 | B |
| Example 5 | Toner 2 | 3 | 200 | 1.47 | A | 1.45 | B |
| Example 6 | Toner 2 | 3 | 150 | 1.45 | B | 1.43 | B |
| Example 7 | Toner 4 | 3 | 150 | 1.44 | B | 1.42 | B |
| Example 8 | Toner 5 | 3 | 150 | 1.44 | B | 1.42 | B |
| Example 9 | Toner 6 | 3 | 150 | 1.43 | B | 1.41 | B |
| Example 10 | Toner 7 | 3 | 150 | 1.44 | B | 1.42 | B |
| Example 11 | Toner 8 | 3 | 150 | 1.43 | B | 1.41 | B |
| Example 12 | Toner 9 | 3 | 150 | 1.39 | B | 1.36 | B |
| Example 13 | Toner 10 | 3 | 150 | 1.37 | B | 1.35 | B |
| Example 14 | Toner 11 | 3 | 150 | 1.38 | B | 1.35 | B |
| Example 15 | Toner 12 | 3 | 150 | 1.38 | B | 1.36 | B |
| Example 16 | Toner 13 | 3 | 150 | 1.37 | B | 1.35 | B |
| Example 17 | Toner 10 | 2 | 150 | 1.37 | B | 1.35 | B |
| Example 18 | Toner 10 | 1 | 150 | 1.34 | B | 1.31 | B |
| Example 19 | Toner 10 | 4 | 150 | 1.33 | B | 1.30 | B |
| Example 20 | Toner 10 | 5 | 150 | 1.33 | B | 1.30 | B |
| Example 21 | Toner 10 | 6 | 150 | 1.34 | B | 1.31 | B |
| Example 22 | Toner 10 | 7 | 150 | 1.32 | B | 1.30 | B |
| Reference Example 1 | Toner 14 | 3 | 150 | 1.33 | C | 1.28 | C |
| Reference Example 2 | Toner 15 | 3 | 150 | 1.30 | C | 1.29 | C |
| Reference Example 3 | Toner 16 | 3 | 150 | 1.31 | B | 1.26 | C |
| Reference Example 4 | Toner 17 | 3 | 150 | 1.34 | C | 1.33 | C |
| Comparative Example 1 | Toner 10 | 8 | 150 | 1.33 | B | 1.31 | C |
| Comparative Example 2 | Toner 10 | 9 | 150 | 1.35 | B | 1.33 | C |

<Production of Toner Carrier 10>

(Preparation of Substrate)

Prepared as the substrate 2 was a product obtained by applying and baking a primer (trade name: DY35-051; manufactured by Dow Corning Toray Co., Ltd.) onto a ground cylindrical tube made of aluminum having an outer diameter of 10 mmcp (diameter) and an arithmetic average roughness Ra of 0.2 μm.

(Production of Elastic Roller)

The substrate prepared in the foregoing was placed in a metal mold and an addition-type silicone rubber composition obtained by mixing the following materials was poured into a cavity formed in the die.

Liquid silicone rubber material (trade name: SE 6724 A/B; manufactured by Dow Corning Toray Co., Ltd.): 100 parts by mass Carbon black (trade name: TOKABLACK #4300; manufactured by Tokai Carbon Co., Ltd.): 15 parts by mass Silica powder as heat resistance-imparting agent: 0.2 part by mass Platinum catalyst: 0.1 part by mass Subsequently, the metal mold was heated to vulcanize and cure the silicone rubber at a temperature of 150° C. for 15 minutes. The substrate having formed on its peripheral surface a cured silicone rubber layer was removed from the metal mold, and then the curing reaction of the silicone rubber layer was completed by further heating the substrate at a temperature of 180° C. for 1 hour. Thus, an elastic roller D-2 in which a silicone rubber elastic layer having a thickness of 0.5 mm and a diameter of 11 mm was formed on the outer periphery of the substrate 2 was produced.

<Production of Surface Layer>

617.9 Parts by mass of the isocyanate group-terminated prepolymer A-1, 34.2 parts by mass of the amino compound B-1, 117.4 parts by mass of carbon black (trade name: MA230; manufactured by Mitsubishi Chemical Corporation), and 130.4 parts by mass of urethane resin fine particles (trade name: ART PEARL C-400; manufactured by Negami Chemical Industrial Co., Ltd.) were stirred and mixed as materials for the surface layer 4.

Next, MEK was added so that the total solid content ratio became 30 mass %. Thus, a paint for forming a surface layer was prepared.

Next, the rubber-free portion of the elastic roller D-2 produced in advance was masked. The masked roller was vertically raised and rotated at 1,500 rpm, and the paint was applied thereto while a spray gun was lowered at 30 mm/s. Subsequently, the applied layer was cured and dried by being heated in a hot-air drying furnace at a temperature of 180° C. for 20 minutes, whereby a surface layer having a thickness of 8 μm was formed on the outer periphery of the elastic layer. Thus, a toner carrier 10 was produced.

<Production of Toner Carriers 11 to 16>

Paints for forming surface layers were each prepared in the same manner as in the production of the toner carrier 10 except that materials shown in Table 6 below were used as materials for the surface layer 4. Then, toner carriers 11 to 16 were each produced by applying each paint to the elastic roller D-2, and drying and heating the paint in the same manner as in the production of the toner carrier 10.

TABLE 6

| | Isocyanate group-terminated prepolymer | | Compound represented by structural formula (1) | |
|---|---|---|---|---|
| Toner carrier | No. | Part(s) by mass | No. | Part(s) by mass |
| 10 | A-1 | 617.9 | B-1 | 34.2 |
| 11 | | 545.0 | B-2 | 107.2 |
| 12 | | 618.9 | B-3 | 33.2 |
| 13 | A-2 | 527.7 | B-4 | 124.4 |
| 14 | | 575.6 | B-5 | 76.5 |
| 15 | | 623.7 | B-6 | 28.4 |
| 16 | | 584.0 | B-7 | 68.2 |

Example 23

A printer LBP3100 manufactured by Canon Inc. was reconstructed and used in an image output evaluation. The printer was reconstructed so that the toner carrier 7 abutted with an electrostatic latent image bearing member as illustrated in FIG. 4. It should be noted that an abutting pressure was adjusted so that the width of an abutting portion between the toner carrier and the electrostatic latent image bearing member became 1.0 mm. The foregoing is a strict condition for fog in a high-temperature and high-humidity environment because of the absence of any toner-supplying member.

50 Grams of the toner 1 were loaded into the developing apparatus reconstructed as described above, and a developing apparatus was produced by using the resultant and the toner carrier 10.

Next, in a high-temperature and high-humidity environment (32.5° C., 80% RH), a direct-current voltage was applied to a charging member so that a potential on the electrostatic latent image bearing member became −600 V. In addition, an image output test was performed while a direct-current voltage of −300 V was applied to the toner carrier so that the |V1−V2| became 300 V.

In a low-temperature and low-humidity environment (15° C., 10% RH), a direct-current voltage was applied to the charging member so that the potential on the electrostatic latent image bearing member became −800 V. In addition, the image output test was performed while a direct-current voltage of −300 V was applied to the toner carrier so that the |V1−V2| became 500 V.

It should be noted that the image output test was performed by using a horizontal line having a print percentage of 2% as an image on 1,500 sheets of paper that were continuously fed.

As a result, even in the case of a cleaner-less system, in the high-temperature and high-humidity environment, a fog-free and clear image was obtained, and in the low-temperature and low-humidity environment, recoverability was good and a good image free of a cleaner-less ghost resulting from a recovery failure was able to be obtained. Table 7 shows the evaluation results.

Examples 24 to 29

Image output evaluations were each performed in the same manner as in Example 23 by producing a developing apparatus with such a combination of a toner and a toner carrier as shown in Table 7, and setting the |V1−V2| as shown in Table 7.

As a result, in each of all the developing apparatus, a good result was obtained for each of the fog in the high-temperature and high-humidity environment, and the recoverability in the low-temperature and low-humidity environment. Table 7 shows the evaluation results.

TABLE 7

| | | | | High-temperature and high-humidity environment | | | |
|---|---|---|---|---|---|---|---|
| | | | | Initial stage | | After image output on 3,000 sheets | |
| | Toner | Toner carrier | \|V1 − V2\| | Density | Fog | Density | Fog |
| Example 23 | Toner 2 | 10 | 300 | 1.45 | A | 1.43 | B |
| Example 24 | Toner 2 | 11 | 300 | 1.46 | A | 1.44 | A |
| Example 25 | Toner 2 | 12 | 300 | 1.48 | A | 1.45 | A |
| Example 26 | Toner 2 | 13 | 300 | 1.44 | A | 1.43 | B |
| Example 27 | Toner 2 | 14 | 300 | 1.46 | A | 1.44 | B |

TABLE 7-continued

| | | | | | | | |
|---|---|---|---|---|---|---|---|
| Example 28 | Toner 2 | 15 | 300 | 1.45 | A | 1.43 | B |
| Example 29 | Toner 2 | 16 | 300 | 1.47 | A | 1.44 | B |

| | | | Low-temperature and low-humidity environment | | | | |
|---|---|---|---|---|---|---|---|
| | | Toner | | Initial stage | | After image output on 3,000 sheets | |
| | Toner | carrier | \|V1 − V2\| | Density | Recoverability | Density | Recoverability |
| Example 23 | Toner 2 | 10 | 500 | 1.46 | A | 1.46 | B |
| Example 24 | Toner 2 | 11 | 500 | 1.44 | A | 1.42 | A |
| Example 25 | Toner 2 | 12 | 500 | 1.45 | A | 1.43 | A |
| Example 26 | Toner 2 | 13 | 500 | 1.46 | A | 1.43 | B |
| Example 27 | Toner 2 | 14 | 500 | 1.47 | A | 1.44 | B |
| Example 28 | Toner 2 | 15 | 500 | 1.43 | A | 1.41 | B |
| Example 29 | Toner 2 | 16 | 500 | 1.44 | A | 1.42 | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-269663, filed Dec. 26, 2013, which is hereby incorporated by reference herein in its entirety.

What is claimed is:

1. An image-forming apparatus, comprising:

an electrostatic latent image bearing member;

a charging unit for charging a surface of the electrostatic latent image bearing member;

an image exposure unit for irradiating the charged surface of the electrostatic latent image bearing member with image exposure light to form an electrostatic latent image on the surface of the electrostatic latent image bearing member;

a developing apparatus for developing the electrostatic latent image formed on the surface of the electrostatic latent image bearing member to form a toner image on the surface of the electrostatic latent image bearing member;

a transferring unit for transferring the toner image formed on the surface of the electrostatic latent image bearing member onto a transfer material through or without through an intermediate transfer member; and a fixing unit for fixing the toner image transferred onto the transfer material onto the transfer material, the image-forming apparatus being configured to recover transfer residual toner on the surface of the electrostatic latent image bearing member after the transfer of the toner image with the developing apparatus, wherein:

the developing apparatus includes toner for developing the electrostatic latent image, a toner carrier for carrying the toner, and a regulating member for regulating a layer thickness of the toner carried by the toner carrier;

the toner carrier is placed to be brought into contact with the electrostatic latent image bearing member;

the toner carrier includes a substrate, an elastic layer, and a surface layer containing a urethane resin;

the urethane resin has a partial structure derived from a reaction between a compound represented by the following structural formula (1) and a polyisocyanate;

the toner comprises magnetic toner containing toner particles each containing a binder resin and a magnetic material, and inorganic fine particles;

the toner has a weight average particle diameter (D4) of 9.5 μm or more and 14.0 μm or less; and a porosity of the toner obtained from the following mathematical expression (1) is 50 or more and 56 or less:

$$\text{Porosity}=((\text{true density}-\text{tap density})/\text{true density})\times 100 \qquad \text{Mathematical expression (1)}$$

Structural formula (1)

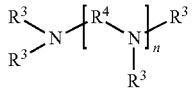

in the structural formula (1):

n represents an integer of 1 or more and 4 or less;

$R^3$'s each independently represent a group selected from the group consisting of the following (a) to (c):

(a) a hydroxyalkyl group having 2 or more and 8 or less carbon atoms, (b) an aminoalkyl group having 2 or more and 8 or less carbon atoms, and (c) a group represented by the following structural formula (2); and $R^4$ represents an alkylene group having 2 or more and 4 or less carbon atoms:

Structural formula (2)

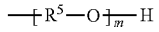

in the structural formula (2):

m is 2 or 3; and $R^5$ represents an alkylene group having 2 or more and 5 or less carbon atoms.

2. An image-forming apparatus according to claim 1, wherein a ratio (D4/D1) of the weight average particle diameter (D4) of the toner to a number average particle diameter (D1) of the toner is 1.30 or less.

3. An image-forming apparatus according to claim 1, wherein:

the toner contains fine particles having a number average particle diameter (D1) of primary particles of 100 nm or more and 2.0 μm or less; and the fine particles comprise at least one kind of fine particles selected from the group consisting of resin fine particles, strontium titanate fine particles, barium titanate fine particles, and calcium titanate fine particles.

4. An image-forming method, comprising:

a charging step of charging a surface of an electrostatic latent image bearing member;

an image exposure step of irradiating the charged surface of the electrostatic latent image bearing member with image exposure light to form an electrostatic latent image on the surface of the electrostatic latent image bearing member;

a developing step of developing the electrostatic latent image formed on the surface of the electrostatic latent image bearing member with a developing apparatus to form a toner image on the surface of the electrostatic latent image bearing member;

a transferring step of transferring the toner image formed on the surface of the electrostatic latent image bearing member onto a transfer material through or without through an intermediate transfer member; and a fixing step of fixing the toner image transferred onto the transfer material onto the transfer material, the image-forming method including recovering transfer residual toner on the surface of the electrostatic latent image bearing member after the transfer of the toner image with the developing apparatus, wherein:

the developing apparatus includes toner for developing the electrostatic latent image, a toner carrier for carrying the toner, and a regulating member for regulating a layer thickness of the toner carried by the toner carrier;

the toner carrier is placed to be brought into contact with the electrostatic latent image bearing member;

the toner carrier includes a substrate, an elastic layer, and a surface layer containing a urethane resin;

the urethane resin has a partial structure derived from a reaction between a compound represented by the following structural formula (1) and a polyisocyanate;

the toner comprises magnetic toner containing toner particles each containing a binder resin and a magnetic material, and inorganic fine particles;

the toner has a weight average particle diameter (D4) of 9.5 μm or more and 14.0 μm or less; and a porosity of the toner obtained from the following mathematical expression (1) is 50 or more and 56 or less:

Porosity=((true density−tap density)/true density)×100 Mathematical expression (1)

Structural formula (1)

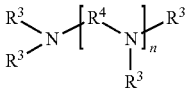

in the structural formula (1):

n represents an integer of 1 or more and 4 or less;

$R^3$'s each independently represent a group selected from the group consisting of the following (a) to (c):

(a) a hydroxyalkyl group having 2 or more and 8 or less carbon atoms, (b) an aminoalkyl group having 2 or more and 8 or less carbon atoms, and (c) a group represented by the following structural formula (2); and $R^4$ represents an alkylene group having 2 or more and 4 or less carbon atoms:

Structural formula (2)

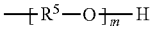

in the structural formula (2):

m is 2 or 3; and $R^5$ represents an alkylene group having 2 or more and 5 or less carbon atoms.

5. An image-forming method according to claim 4, wherein a ratio (D4/D1) of the weight average particle diameter (D4) of the toner to a number average particle diameter (D1) of the toner is 1.30 or less.

6. An image-forming method according to claim 4, wherein:

the toner contains fine particles having a number average particle diameter (D1) of primary particles of 100 nm or more and 2.0 μm or less; and the fine particles comprise at least one kind of fine particles selected from the group consisting of resin fine particles, strontium titanate fine particles, barium titanate fine particles, and calcium titanate fine particles.

7. An image-forming method according to claim 4, wherein an absolute value (|V1−V2|) of a difference between a potential (V1) of the surface of the electrostatic latent image bearing member when the surface of the electrostatic latent image bearing member is charged in the charging step and a direct-current voltage (V2) to be applied to the toner carrier when the electrostatic latent image is developed in the developing step is 200 V or more and 600 V or less.

8. A developing apparatus for developing an electrostatic latent image formed on a surface of an electrostatic latent image bearing member to form a toner image on the surface of the electrostatic latent image bearing member, the developing apparatus comprising:

toner for developing the electrostatic latent image;

a toner carrier for carrying the toner; and a regulating member for regulating a layer thickness of the toner carried by the toner carrier, wherein:

the toner carrier is placed to be brought into contact with the electrostatic latent image bearing member;

the toner carrier includes a substrate, an elastic layer, and a surface layer containing a urethane resin;

the urethane resin has a partial structure derived from a reaction between a compound represented by the following structural formula (1) and a polyisocyanate;

the toner comprises magnetic toner containing toner particles each containing a binder resin and a magnetic material, and inorganic fine particles;

the toner has a weight average particle diameter (D4) of 9.5 μm or more and 14.0 μm or less; and a porosity of the toner obtained from the following mathematical expression (1) is 50 or more and 56 or less:

Porosity=((true density−tap density)/true density)×100 Mathematical expression (1)

Structural formula (1)

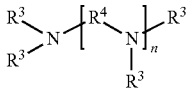

in the structural formula (1):

n represents an integer of 1 or more and 4 or less;

$R^3$'s each independently represent a group selected from the group consisting of the following (a) to (c):

(a) a hydroxyalkyl group having 2 or more and 8 or less carbon atoms, (b) an aminoalkyl group having 2 or more and 8 or less carbon atoms, and (c) a group represented by the following structural formula (2); and $R^4$ represents an alkylene group having 2 or more and 4 or less carbon atoms:

Structural formula (2)

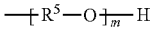

in the structural formula (2):

m is 2 or 3; and $R^5$ represents an alkylene group having 2 or more and 5 or less carbon atoms.

9. A developing apparatus according to claim 8, wherein a ratio (D4/D1) of the weight average particle diameter (D4) of the toner to a number average particle diameter (D1) of the toner is 1.30 or less.

10. A developing apparatus according to claim 8, wherein:

the toner contains fine particles having a number average particle diameter (D1) of primary particles of 100 nm or more and 2.0 μm or less; and the fine particles comprise at least one kind of fine particles selected from the group consisting of resin fine particles, strontium titanate fine particles, barium titanate fine particles, and calcium titanate fine particles.

11. A developing method, comprising developing an electrostatic latent image formed on a surface of an electrostatic latent image bearing member with a developing apparatus to form a toner image on the surface of the electrostatic latent image bearing member, wherein:

the developing apparatus includes toner for developing the electrostatic latent image, a toner carrier for carrying the toner, and a regulating member for regulating a layer thickness of the toner carried by the toner carrier;

the toner carrier is placed to be brought into contact with the electrostatic latent image bearing member;

the toner carrier includes a substrate, an elastic layer, and a surface layer containing a urethane resin;

the urethane resin has a partial structure derived from a reaction between a compound represented by the following structural formula (1) and a polyisocyanate;

the toner comprises magnetic toner containing toner particles each containing a binder resin and a magnetic material, and inorganic fine particles;

the toner has a weight average particle diameter (D4) of 9.5 μm or more and 14.0 μm or less; and a porosity of the toner obtained from the following mathematical expression (1) is 50 or more and 56 or less:

Porosity=((true density−tap density)/true density)×100 Mathematical expression (1)

Structural formula (1)

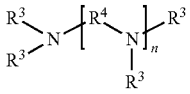

in the structural formula (1):

n represents an integer of 1 or more and 4 or less;

$R^3$'s each independently represent a group selected from the group consisting of the following (a) to (c):

(a) a hydroxyalkyl group having 2 or more and 8 or less carbon atoms, (b) an aminoalkyl group having 2 or more and 8 or less carbon atoms, and (c) a group represented by the following structural formula (2); and $R^4$ represents an alkylene group having 2 or more and 4 or less carbon atoms:

Structural formula (2)

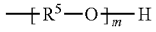

in the structural formula (2):

m is 2 or 3; and $R^5$ represents an alkylene group having 2 or more and 5 or less carbon atoms.

12. A developing method according to claim 11, wherein a ratio (D4/D1) of the weight average particle diameter (D4) of the toner to a number average particle diameter (D1) of the toner is 1.30 or less.

13. A developing method according to claim 11, wherein:

the toner contains fine particles having a number average particle diameter (D1) of primary particles of 100 nm or more and 2.0 μm or less; and the fine particles comprise at least one kind of fine particles selected from the group consisting of resin fine particles, strontium titanate fine particles, barium titanate fine particles, and calcium titanate fine particles.

* * * * *